US008712080B2

(12) United States Patent
Tani et al.

(10) Patent No.: US 8,712,080 B2
(45) Date of Patent: Apr. 29, 2014

(54) DISPLAY SYSTEM, DISPLAY CONTROL METHOD AND COMPUTER PROGRAM

(75) Inventors: Daisuke Tani, Osaka (JP); Taikoh Akashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 339 days.

(21) Appl. No.: 13/114,232

(22) Filed: May 24, 2011

(65) Prior Publication Data

US 2011/0293122 A1 Dec. 1, 2011

(30) Foreign Application Priority Data

May 26, 2010 (JP) ..... 2010-120837

(51) Int. Cl.
*H04R 5/02* (2006.01)

(52) U.S. Cl.
USPC ..... 381/306; 381/333; 381/61

(58) Field of Classification Search
USPC ..... 381/306, 186, 388, 333, 61
See application file for complete search history.

(56) References Cited

U.S. PATENT DOCUMENTS

| | | | | |
|---|---|---|---|---|
| 7,602,924 | B2 * | 10/2009 | Kleen | 381/61 |
| 8,295,516 | B2 * | 10/2012 | Kondo et al. | 381/306 |
| 8,395,713 | B2 * | 3/2013 | Kondo et al. | 348/734 |
| 2008/0165992 | A1 * | 7/2008 | Kondo et al. | 381/182 |

FOREIGN PATENT DOCUMENTS

| | | |
|---|---|---|
| JP | 2002-320298 | 10/2002 |
| JP | 2002-345079 | 11/2002 |
| JP | 2004-187288 | 7/2004 |
| JP | 2007-053610 | 3/2007 |
| JP | 2007-164060 | 6/2007 |
| JP | 2008-011475 | 1/2008 |
| JP | 2008-109209 | 5/2008 |

* cited by examiner

*Primary Examiner* — Disler Paul
(74) *Attorney, Agent, or Firm* — Edwards Wildman Palmer LLP; George W. Neuner

(57) ABSTRACT

It is expected to provide a display system, display control method and computer program for effectively outputting sound with plural display apparatuses in a two dimensional array.

A control apparatus 2 is connected to a two dimensional array display apparatus unit made with display apparatuses 1, 1, . . . configuring a multivision system. A controlling unit 20 of the control apparatus 2 obtains position information for the display apparatus unit in the two dimensional array. Based on the position of each display apparatus 1 in the two dimensional array display apparatus unit, the controlling unit 20 decides the presence or absence of output sound and selects the channel for the output sound.

6 Claims, 23 Drawing Sheets

DISPLAY SYSTEM, DISPLAY CONTROL METHOD AND COMPUTER PROGRAM

(US) CROSS-REFERENCE TO RELATED APPLICATION

This Nonprovisional application claims priority under 35 U.S.C. §119(a) on Patent Application No. 2010-120837 filed in Japan on May 26, 2010, the entire contents of which are hereby incorporated by reference.

BACKGROUND OF THE INVENTION

1. Field of the Invention

The present invention relates to a system that utilizes plural display apparatuses, each of which includes a loudspeaker and which outputs an image and sound, and relates to a display system, display control method and computer program for effectively outputting sound with juxtaposed plural display apparatuses.

2. Description of Related Art

It is known about a system, so called a multivision system that includes a large screen display configured with juxtaposed displayed apparatuses (such as liquid crystal displays [LCDs] or plasma displays). The multivision system is utilized in a large space, such as a fairground or communal facility, to show images on the large screen display for the purpose of live broadcasts, advertisements and the like.

The multivision system is provided with a control apparatus that makes a zoom apparatus zoom television signals or video signals to be displayed on the large screen display, or video signals including screen output signals from a personal computer to be displayed on the large screen display, which divides these signals for each display apparatus and which transmits the divided signals for each display apparatus. Each display apparatus performs display processing based on the video signals transmitted by the control apparatus, and thus an entire image is displayed on the large screen display.

Recent development of technology implements relatively narrowing bezel width as viewed from the front of display apparatus configured with a LCD or plasma display, and implements relatively increasing the panel area as viewed from the front. In the case that plural display apparatuses are juxtaposed with each other while each bezel width is wider, it causes wider panel boundary areas where images are not displayed. Thus, it is not easy to see the whole image on the large screen display in such a case, and there are few advantages in such a case for utilizing the multivision system. However, in the case that the bezel width is narrower, the large screen display with plural display apparatuses can implement exciting image display and the advantages are increased in the latter case with utilizing the multivision system.

The multivision system is given a developmental assignment, how to divide the image. In the case that there is a previous set indicating divided video signals to be received by each display apparatus, it requires complicated processes because the previous set should be adjusted in accordance with the desired number of display apparatuses.

Japanese Patent Application Laid-Open No. 2007-164060 describes an invention that utilizes two display apparatuses juxtaposed with each other to make one screen display, that includes detectors for the top, bottom, right and left portions of each display apparatus, that makes each display apparatus recognize the right and left positions, and that makes each display apparatus display a part of image in accordance with its own position (i.e., right or left) recognized from the received video signals. In addition, Japanese Patent Application Laid-Open No. 2008-109209 describes an invention that utilizes a system configured with plural displays and plural loudspeakers arranged to surround the plural displays, and that performs sound signal processing for sound corresponding to the image displayed on the screen display.

SUMMARY OF THE INVENTION

The developmental assignment given to the multivision system is not only how to divide the image, but also how to output the sound. In the configuration that each display apparatus outputs the sound similarly to the other display apparatuses and that stereo loudspeakers of each display apparatus respectively output the sound for the left and right channels, it is hard to implement the sense of reality and exciting sound because the sound divided for the right and left channels are not meaningful. Meanwhile, it is considered to make the loudspeakers of each display apparatus output no sound and to provide a different loudspeaker. However, this consideration requires extra costs and spaces for the different loudspeaker, although a recent display apparatus includes a loudspeaker that implements relatively higher performance.

The invention described in Japanese Patent Application Laid-Open No. 2007-164060 can utilize two display apparatuses and then select one of right and left loudspeakers for outputting sounds, too. However, Japanese Patent Application Laid-Open No. 2007-164060 describes nothing about the setting for utilizing more than two display apparatuses. As the invention described in Japanese Patent Application Laid-Open No. 2007-164060 includes the setting for utilizing two display apparatuses, each display apparatus can select outputting of sounds categorized in any one of channels in accordance with the previous set after recognizing its own position (right or left). However, such a display apparatus cannot recognize its own position only with the detectors described above, cannot decide the part of image to be displayed among the received video signals, and cannot select the sound of channel to be output, when having no information indicating the number of utilized display apparatuses. Therefore, it is difficult to automatically select in accordance with various juxtapositions, and it is not enough to provide convenience for dealing with various type of multivision systems.

The invention described in Japanese Patent Application Laid-Open No. 2008-109209 is based on an assumption that some different images are respectively displayed on plural display screens, selects the sound corresponding to an active display screen (i.e., the sound corresponding to an image selected by a user), and then performs selection of loudspeakers arranged at the position corresponding to the display screen that displays the selected image, but is not directed to utilize a display apparatus that originally includes loudspeakers.

As described above, it is expected to increase the advantages for implementing the multivision system configured with the recent display apparatuses. However, it has not been considered enough to develop the technique for effectively outputting sounds from the display apparatuses based on the various juxtapositions of display apparatuses.

The present invention is made in view of such circumstances and has an object to provide a display system, display control method and computer program for effectively outputting sounds with plural juxtaposed display apparatuses.

According to an aspect of the present invention, a juxtaposition display apparatus unit is configured with plural juxtaposed display apparatuses, each of which integrally includes a loudspeaker. A controlling means is provided for controlling the sound output performed by each display apparatus.

Thus, the sound output from the loudspeaker of each display apparatus is controlled by the controlling means in accordance with the position of each display apparatus against the juxtaposed display apparatuses. Therefore, it is possible to properly output the multi-channel sound from each display apparatus based on position information of said each display apparatus, when the controlling means obtains the juxtaposition information of display apparatuses. However, said each display apparatus is not required selecting for the output sound. The display apparatuses are juxtaposed at least in the horizontal direction, while display apparatuses may be juxtaposed in the vertical direction and then may form a tessellated structure or a honeycomb structure.

According to an aspect of the present invention, the controlling means decides whether sound should be output from each loudspeaker of the display apparatus or not, in accordance with the position of the relay apparatus within the juxtaposition display apparatus unit where the position information represents. When having decided that sound should be output from a predetermined loudspeaker, the controlling means further selects a channel of sound to be output among the plural channels. The multivision system can allow a display apparatus to output no sound. Therefore, it is possible to properly output multi-channel sound with saving the electric power consumption required for outputting sound. Hence, it is possible to output sound of right channel from a loudspeaker of the display apparatus positioned at the right side of the juxtaposition display apparatus unit, and to output sound of left channel from a loudspeaker of the display apparatus positioned at the left side of the juxtaposition display apparatus unit. It is further possible to output sound of bass channel from a loudspeaker positioned at the lower side of the display apparatus. Therefore, multi-channel sound can be effectively output, because the channel of sound is properly selected for each loudspeaker and some loudspeaker may output no sound.

According to an aspect of the present invention, the whole of juxtaposition display apparatus unit contributes to display one image, and automatic selection is performed to make a loudspeaker of the display apparatus juxtaposed at the left side of the juxtaposition display apparatus unit output the sound of left channel, and to make a loudspeaker of the display apparatus juxtaposed at the right side of the juxtaposition display apparatus unit output the sound of right channel. Therefore, it is possible to effectively output stereo sound including the right and left channels. It is further possible to perform the automatic selection for making a loudspeaker of the display apparatus positioned at the lower side of the juxtaposition display apparatus unit output the sound of bass channel.

According to an aspect of the present invention, the juxtaposition display apparatus unit can be made with a plurality of horizontal juxtaposition units, each of which is configured with an odd number of horizontally juxtaposed display apparatuses and is juxtaposed vertically to another horizontal juxtaposition unit. In such a juxtaposition display apparatus unit, some display apparatuses are positioned on the vertical center line of the juxtaposition display apparatus unit that can display one image. Thus, the automatic selection is normally performed to make the display apparatuses positioned on the vertical center line output the normal sound, i.e., to make the loudspeaker positioned at the right side of the vertical center line output the sound of right channel and to make the loudspeaker positioned at the left side of the vertical center line output the sound of left channel. Furthermore, the automatic selection is performed to make loudspeakers of the display apparatuses positioned at the right side of the vertical center line output the sound of right channel, and to make loudspeakers of the display apparatuses positioned at the left side of the vertical center line output the sound of left channel. Therefore, it is possible to effectively output multi-channel sound including the right and left channels.

According to an aspect of the present invention, the whole of juxtaposition display apparatus unit contributes to display one image and the center of juxtaposition display apparatus unit is defined as a base. When the sound of right channel is selected for the loudspeaker of a predetermined display apparatus, the sound of left channel is automatically selected for the loudspeaker of another display apparatus positioned symmetrically to the predetermined display apparatus about the center. Similar selection is performed in the left to right case. Therefore, it is well balanced to output the stereo sound, symmetrically.

According to an aspect of the present invention, the whole of juxtaposition display apparatus contributes to display one image and it is controlled to output the sound only from a loudspeaker of the display apparatus positioned at the outer side of the juxtaposition display apparatus unit. Thus, it is possible to implement well-balanced output of right/left sound or deep bass sound, while saving the electric power consumption required for outputting sound from the whole multivision system. Therefore, it is possible to effectively output the multi-channel sound.

According to an aspect of the present invention, the whole of juxtaposition display apparatus unit contributes to display one image and the center of juxtaposition display apparatus is defined as a base. The display apparatus positioned at the right side can output sound only from a right loudspeaker, and the display apparatus positioned at the left side can output sound only from a left loudspeaker. Thus, it is possible to implement well-balanced output of right/left sound or deep bass sound, while saving the electric power consumption required for outputting sound from the whole multivision system. Therefore, it is possible to effectively output the multi-channel sound.

According to an aspect of the present invention, the display apparatuses are juxtaposed to form a plurality of horizontal layers, each of which is juxtaposed vertically to another horizontal layer. Furthermore, every other horizontal layer or every plural layers of display apparatuses are set to output no sound. Therefore, it is possible to save the electric power consumption required for outputting sound from the whole multivision system.

According to an aspect of the present invention, sound is output only from a loudspeaker of the display apparatus positioned at the lowest layer. Therefore, it is possible to save the electric power consumption required for outputting sound from the whole multivision system.

According to an aspect of the present invention, the whole of juxtaposition display apparatus contributes to display one image and the center of juxtaposition display apparatus is defined as a base. When sound is decided to be output from a loudspeaker of a predetermined display apparatus, sound is automatically decided to be output from a loudspeaker of another display apparatus positioned line-symmetrically to the predetermined display apparatus about the center. Therefore, well-balanced sound is output symmetrically from right and left.

According to an aspect of the present invention, the whole of juxtaposition display apparatus unit contributes to display one image and is configured with plural display apparatuses. It is possible through the control screen to decide whether a loudspeaker of each display unit should output sound or not and to select the channel for each loudspeaker. Thus, a user can easily perform the selection. Therefore, it is possible to facilitate the setting for the display systems with various juxtaposed structures.

According to an aspect of the present invention, it is possible to effectively utilize loudspeakers included in the display apparatuses without providing extra loudspeakers to the multivision system, to prevent the multi-channel sound from being interfered, to prevent the degradation of sound effect, and to effectively output multi-channel sound. In addition, some display apparatus may be allowed to output no sound in the plural display apparatuses utilized for displaying one image. Therefore, it is possible to save the electric power consumption required for outputting sound from the whole multivision system.

The above and further objects and features of the invention will more fully be apparent from the following detailed description with accompanying drawings.

DESCRIPTION OF THE PREFERRED EMBODIMENTS

Hereinafter, embodiments of the present invention are described in detail with reference to the figures.

(Embodiment 1)

Figure 1:
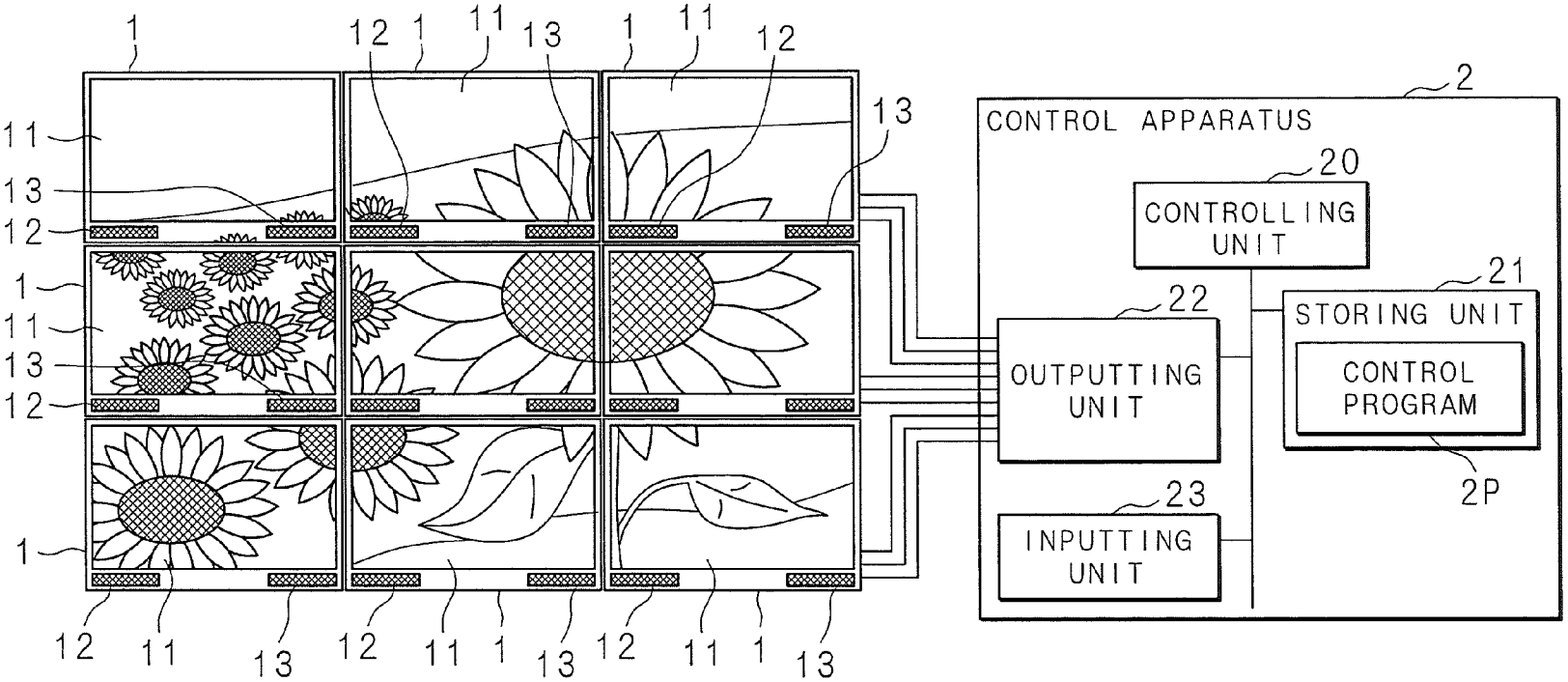
FIG. 1 is a schematic view showing a configuration of a display system in an embodiment 1.

FIG. 1 is a schematic view showing a configuration of a display system in the embodiment 1. The Display System Includes plural display apparatuses 1, 1 . . . and a control apparatus 2 connected to the display apparatuses 1, 1 . . . . Nine display apparatuses 1, 1, . . . are utilized in FIG. 1, and juxtaposed to form a juxtaposition display apparatus unit in a tessellated structure with three layers (rows) and three vertical lanes.

The display apparatus 1 includes a panel 11, a left loudspeaker 12 and a right loudspeaker 13. The panel 11 is a LCD or plasma display. As vied from the front, the display apparatus 1 includes the loudspeaker 12 at the left lower side and the loudspeaker 13 at the right lower side. The display apparatus 1 may also include another loudspeaker at the left side, another loudspeaker at the right side, and a deep bass loudspeaker at the center lower side.

As described later, the display apparatus 1 displays an image on the panel 11 based on image signals that are output from the control apparatus 2. Similarly, the display apparatus 1 outputs sound from the left loudspeaker 12 and/or the right loudspeaker 13 based on sound signals that are included in the image signals or are output together with the image signals.

The control apparatus 2 is a personal computer that includes a controlling unit 20, a storing unit 21, an outputting unit 22 and an inputting unit 23. The controlling unit 20 is a central processing unit (CPU). The controlling unit 20 reads out a control program 2P stored in a storing unit 21 onto an internal memory and executes the read control program 2P, and thus makes the computer work as a controlling means of the display system according to the present invention. The storing unit 21 is an external storage apparatus, such as a hard disk drive or a solid state drive (SSD). The storing unit 21 stores not only the control program 2P but also image data in which the image to be displayed by the display apparatus 1 is multiplexed with the sound to be output from the display apparatus 1, set condition data that represents the set condition utilized for control processing by the controlling unit 20, and the like. The outputting unit 22 is connected to the display apparatuses 1, 1, . . . , and output video signals (image signal and sound signal) to the display apparatus 1 in accordance with the instruction of the controlling unit 20. When a display apparatus 1 is connected to the control apparatus 2, the outputting unit 22 detects the connection and notifies the controlling unit 20 of the connection. Thus, the controlling unit 20 can recognize the number of connected display apparatuses 1, 1, . . . through the outputting unit 22. The inputting unit 23 is connected to a user interface, such as a keyboard and a mouse (not shown). Thus, the inputting unit 23 can accept information input by a user and notify the controlling unit 20 of the input information.

Based on the processing performed by the controlling unit 20 in accordance with the control program 2P, the control apparatus 2 obtains information about the number and juxtapositions of display apparatuses 1, 1, . . . connected through the outputting unit 22 to the control apparatus 2. Then, the control apparatus 2 controls the presence/absence of the output sound and the selection of the sound channel, in accordance with the position of each display apparatus 1 in the juxtaposed display apparatuses 1, 1, . . . .

It will be described below with reference to a flowchart about control processing for sound output to the display apparatuses 1, 1, . . . performed by the controlling unit 20 of the control apparatus 2.

Figure 2:
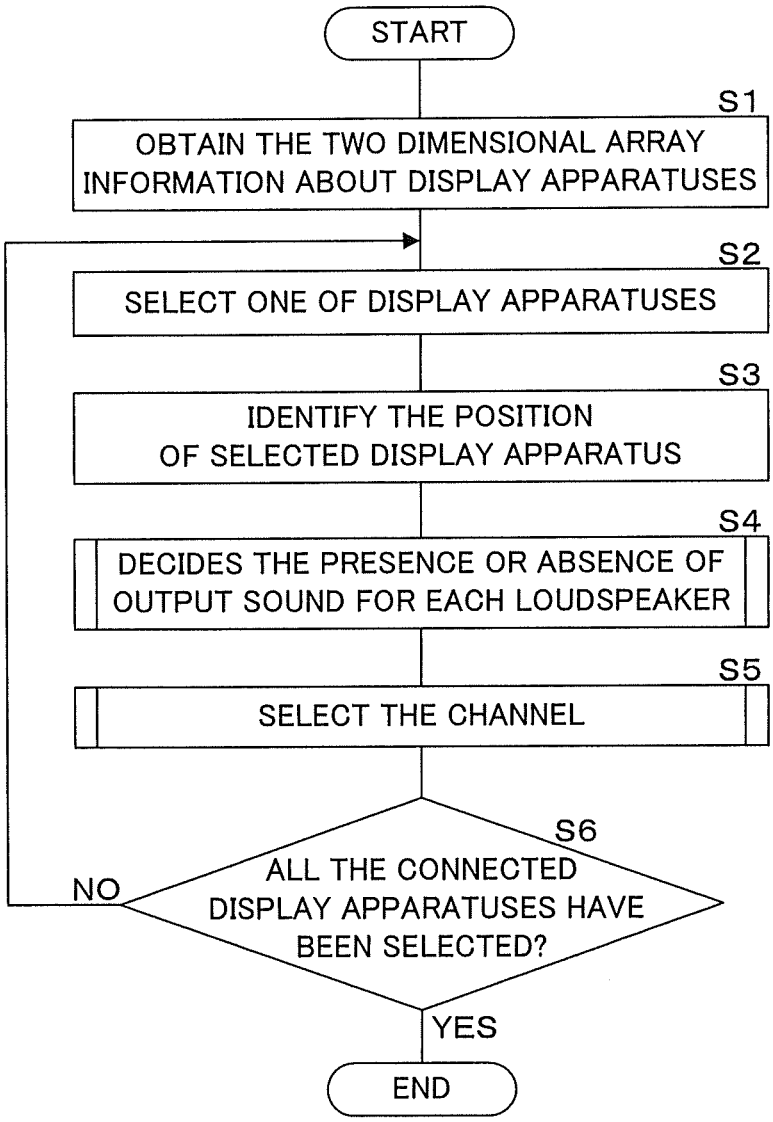
FIG. 2 is a flowchart showing an example of procedure for sound output control processing performed by a controlling unit included by a control apparatus that consists in a display system of the embodiment 1.

FIG. 2 is a flowchart showing an example of procedure for the sound output control processing performed by the controlling unit 20 included by the control apparatus 2 that consists in a display system of the embodiment 1.

The controlling unit 20 obtains juxtaposition information about display apparatuses 1, 1, . . . connected to the control apparatus 2 (step S1). The juxtaposition information may be previously stored in the storing unit 21 or may be input by a user from the imputing unit 23. For example, the juxtaposition information consists of the identification information and position information (coordinate information) of each display apparatus 1. For example, the position information is represented by an order of the layer and an order of the vertical lane. In the case of FIG. 1 including nine display apparatuses, the position of display apparatus 1 juxtaposed at the left top side is defined to be the "0th" layer and the "0th" vertical lane, i.e., (0, 0), the position of display apparatus 1 juxtaposed at the right top side is defined to be the "0th" layer and the "2nd" vertical lane, i.e., (0, 2), the position of display apparatus juxtaposed at the left lower side is defined to be the "2nd" layer and the "0th" vertical lane, i.e., (2, 0), the position of display apparatus juxtaposed at the right lower side is defined to be the "2nd" layer and the "2nd" vertical lane, i.e., (2, 2), and the like. In addition, the position information may be previously associated with plural communication terminals of the outputting unit 22, the position information of display apparatus 1 connected to each connection terminal may be automatically recognized, and the juxtaposition information of juxtaposed display apparatuses 1, 1, . . . may be recognized in accordance with all the recognized position information. Based on the position information (0, 0) to (2, 2) of display apparatuses 1, 1, . . . , the controlling unit 20 sets the center position of plural display apparatuses 1, 1, . . . configuring the multivision system to be the median value of layer number and median value of vertical lane number represented by the position information. In other words, the controlling unit 20 sets the center position of plural display apparatuses 1, 1, . . . to be (1, 1). Thus, the controlling unit 20 recognizes that display apparatuses 1, 1, . . . in the 0th vertical lane are positioned at the right side, display apparatuses 1, 1, . . . in the 1st vertical lane are positioned on the center line, and that display apparatuses 1, 1, . . . in the 2nd vertical lane are positioned at the left side.

Even in the case that nine display apparatuses 1, 1, . . . are juxtaposed to form one screen (i.e., nine display apparatuses 1, 1, are in a two dimensional array), four display apparatuses 1, 1, . . . may be utilized for displaying one image while two, three or all of the remaining five display apparatuses 1, 1, . . . may be utilized for displaying one image. Hence, the center position may be (0.5, 0.5) based on the position information (0, 0) to (1, 1) of four display apparatuses 1, 1, . . . , and the controlling unit 20 may recognize that display apparatuses 1, 1, . . . in the 0th vertical lane are positioned at the right side and that display apparatuses 1, 1, . . . in the 1st vertical lane are positioned at the left side.

The controlling unit 20 selects one from the display apparatuses 1, 1, . . . connected to the control apparatus 2 (step S2), and identifies the position of selected display apparatus 1 (step S3). The positional identification can be performed in accordance with the position information of the display apparatus selected as described above.

Based on the identified position, the controlling unit 20 decides the presence/absence of the output sound for each loudspeaker (i.e., each of left loudspeaker 12 and right loudspeaker 13) included by the selected display apparatus 1 (step S4). It will be described later in detail about the presence/absence decision of the output sound for each loudspeaker.

Then, the controlling unit 20 selects the channel of each loudspeaker (i.e., each of left loudspeaker 12 and right loudspeaker 13) included by the selected display apparatus 1, in accordance with identified positions of respective display apparatuses 1, 1, . . . (step S5). It will be described later in detail about the channel selection for each loudspeaker, too.

The controlling unit 20 determines whether all the connected display apparatuses 1, 1, . . . have been selected or not (step S6). When having determined that all the display apparatuses 1, 1, . . . have not been selected (S6: NO), the controlling unit 20 returns the procedure to the step S2 and performs the procedure for another display apparatus 1. When having determined that all the display apparatuses 1, 1, . . . have been selected (S6: YES), the controlling unit 20 ends the sound output control processing.

It will be described below in detail about the presence/absence decision of the output sound for each loudspeaker at the step S4.

Figure 3:
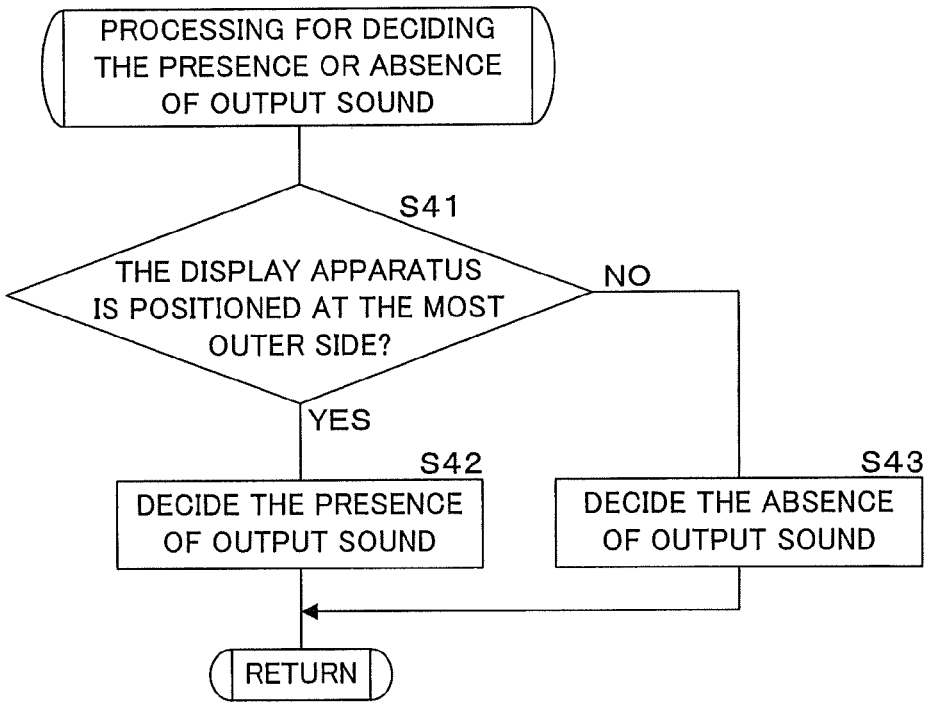
FIG. 3 is a flowchart showing an example of procedure for deciding whether sound should be output or not, which is performed by the controlling unit included by the control apparatus that consists in a display system of the embodiment 1.

FIG. 3 is a flowchart showing an example of procedure for deciding whether sound should be output or not, which is performed by the controlling unit included by the control apparatus 20 that consists in the display system of the embodiment 1.

Based on the obtained position information, the controlling unit 20 determines whether the selected display apparatus 1 is positioned at the most outer side in the plural display apparatuses 1, 1, . . . configuring the multivision system or not (step S41).

When having determined at the step S41 that the selected display apparatus 1 is positioned at the most outer side (S41: YES), the controlling unit 20 decides that the loudspeakers (i.e., left loudspeaker 12 and right loudspeaker 13) should output sound (step S42), and returns to the step S5 shown in the flowchart of FIG. 2. At that time, the controlling unit 20 identifies another display apparatus 1 positioned at the most outer side symmetrically to the selected display apparatus 1, and decides that the loudspeakers of the identified another display apparatus 1 should also output sound.

In the example case of position information described above, the controlling unit 20 determines that the selected display apparatus 1 is positioned at the most outer side when the position information of selected display apparatus 1 represents 0th vertical line or 2nd vertical line. The area of "outer side" may include the positions of display apparatuses 1, 1, . . . in 0th layer and/or 2nd layer. It should be noted that the "outer side" is not limited to the most outer side. In the case that six display apparatuses 1, 1, . . . are juxtaposed in the horizontal direction, the area of "outer side" may include not only the display apparatus 1 positioned at the most outer side but also the subsequent display apparatus 1 positioned closer by one apparatus to the inner side.

When having determined at the step S41 that the selected display apparatus 1 is not positioned at the most outer side (S41: NO), the controlling unit 20 decides that no loudspeaker of the selected display apparatus 1 should output sound (step S43), i.e., decides that neither left loudspeaker 12 nor right loudspeaker 13 should output sound. Then, the controlling unit 20 returns to the step S5 shown in the flowchart of FIG. 2.

In the example case of position information described above, the controlling unit 20 determines that the selected display apparatus 1 is not positioned at the most outer side when the position information of selected display apparatus 1 represents 1st vertical line.

The controlling unit 20 may be configured to recognize not only the position of display apparatus 1 but also the position of loudspeaker, and to decide in accordance with the recognition that the sound should be output only from the loudspeaker positioned at the most outer side. In the example case of position information described above, the controlling unit 20 may determine that the only left loudspeaker 12 of the selected display apparatus 1 is positioned at the outer side and then decide that only the left loudspeaker 12 of the selected display apparatus 1 should output sound when the position information of selected display apparatus 1 represents 0th vertical line, and may determine that the only right loudspeaker 13 of the selected display apparatus 1 is positioned at the outer side and then decide that only the right loudspeaker 13 of the selected display apparatus 1 should output sound when the position information of selected display apparatus 1 represents 2nd vertical line.

Since the controlling unit 20 performs the procedure shown in the flowchart of FIG. 3, the sound is output only from the display apparatus 1 positioned at the outer side among the plural display apparatuses 1, 1, . . . configuring the multivision system. In the example case described above, the sound is output only form the display apparatuses 1, 1, . . . in the 0th vertical lane and from the display apparatuses 1, 1, . . . in the 2nd vertical lane.

Figure 4:
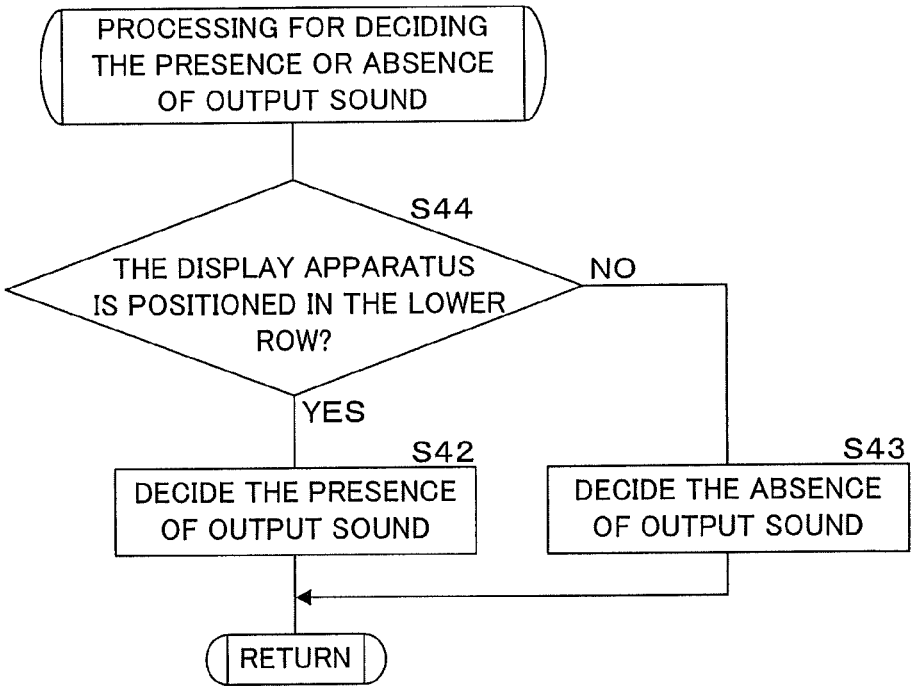
FIG. 4 is a flowchart showing another example of procedure for deciding whether sound should be output or not, which is performed by the controlling unit included by the control apparatus that consists in the display system of the embodiment 1.

FIG. 4 is a flowchart showing another example of procedure for deciding whether sound should be output or not, which is performed by the controlling unit 20 included by the control apparatus 2 that consists in the display system of the embodiment 1. The procedure of FIG. 4 includes steps common to the flowchart of FIG. 3. These common steps are provided with the same step numbers as the flowchart of FIG. 3, and not explained in detail.

Based on the obtained position information, the controlling unit 20 determines whether the selected display apparatus 1 is positioned in the lower layer of the juxtaposition display apparatus unit made with display apparatuses 1, 1, . . . configuring the multivision system (step S44).

When having determined at the step S44 that the selected display apparatus 1 is positioned in the lower layer (S44: YES), the controlling unit 20 decides that the loudspeakers (i.e., left loudspeaker 12 and right loudspeaker 13) of the selected display apparatus 1 should output sound (S42), and returns to the step S5 shown in the flowchart of FIG. 2.

In the example case of position information described above, the controlling unit 20 determines that the selected display apparatus 1 is positioned in the lower layer when the position information of the selected display apparatus 1 represents the 2nd layer.

When having determined at the step S44 that the selected display apparatus 1 is not positioned in the lower layer (S44: NO), the controlling unit 20 decides that no loudspeaker (i.e., neither the left loudspeaker 12 nor right loudspeaker 13) of the selected display apparatus 1 should output sound (S43), and returns to the step S5 shown in the flowchart of FIG. 2.

Since the controlling unit 20 performs the procedure shown in the flowchart of FIG. 4, the sound is output only from the display apparatus 1 positioned in the lower layer of the juxtaposition display apparatus unit made with display apparatuses 1, 1, . . . configuring the multivision system. In the example case described above, the sound is output only from the display apparatuses 1, 1, . . . in the 2nd layer.

Figure 5:
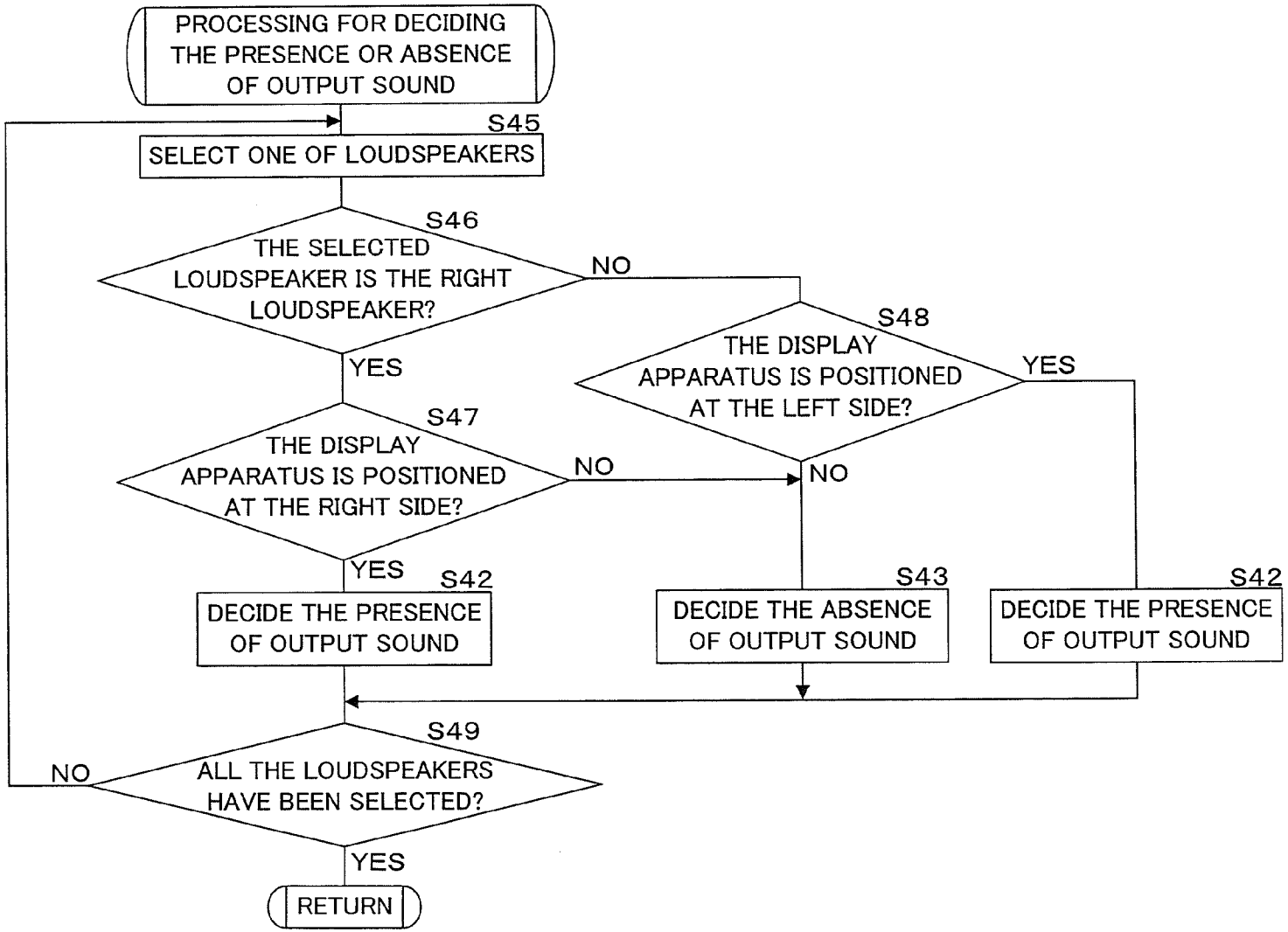
FIG. 5 is a flowchart showing another example of procedure for deciding whether sound should be output or not, which is performed by the controlling unit included by the control apparatus that consists in the display system of the embodiment 1.

FIG. 5 is a flowchart showing another example of procedure for deciding whether sound should be output or not, which is performed by the controlling unit 20 included by the control apparatus 2 that consists in the display system of the embodiment 1. The procedure of FIG. 5 includes steps common to the flowchart of FIG. 3. These common steps are provided with the same step numbers as the flowchart of FIG. 3, and not explained in detail.

The controlling unit 20 selects one of loudspeakers included in the selected display apparatus 1 (step S45). The controlling unit 20 determines whether the selected loudspeaker is the right loudspeaker 13 or not (step S46). When having determined that the selected loudspeaker is the right loudspeaker 13 (S46: YES), the controlling unit 20 determines in accordance with the obtained position information whether the selected display apparatus 1 is positioned at the right side of the juxtaposition display apparatus unit made with display apparatuses 1, 1, . . . configuring the multivision system (step S47).

When having determined at the step S47 that the selected display apparatus 1 is positioned at the right side (S47: YES), the controlling unit 20 decides that the selected loudspeaker should output sound (S42) and proceeds to step S49 described later. When having determined at the step S47 that the selected display apparatus 1 is not positioned at the right side (S47: NO), the controlling unit 20 decides that the selected loudspeaker should not output sound (S43) and proceeds to the step S49 described later.

When having determined that the selected loudspeaker is not the right loudspeaker 13 (S46: NO), the controlling unit 20 determines in accordance with the obtained position information that whether the selected display apparatus 1 is positioned at the left side of the juxtaposition display apparatus unit made with display apparatuses 1, 1, . . . configuring the multivision system (step S48). When having determined that the selected display apparatus 1 does not position at the left side, the controlling unit 20 decides that the selected loudspeaker should not output sound (S43) and proceeds to the step S49 described later.

When having determined that the selected display apparatus 1 is positioned at the left side (S48: YES), the controlling unit 20 decides that the selected loudspeaker should output sound (S42) and proceeds to the step S49 described later.

The controlling unit 20 determines whether all loudspeakers have been selected or not (step S49). When having determined that all loudspeakers have not been selected (S49: NO), the controlling unit 20 returns to the step S45 and performs the procedure for the subsequent loudspeaker. When having determined that all the loudspeakers have been selected (S49: YES), the controlling unit 20 ends the presence/absence decision of the output sound, and returns to the step S5 shown in the flowchart of FIG. 2.

Since the controlling unit 20 performs the procedure shown in the flowchart of FIG. 5, the sound is output only from the right loudspeaker 13 in the display apparatus 1 positioned at the right side of the juxtaposition display apparatus unit made with display apparatuses 1, 1, . . . configuring the multivision system, and only from the left loudspeaker 12 in the display apparatus 1 positioned at the left side of the juxtaposition display apparatus unit made with display apparatuses 1, 1, . . . configuring the multivision system.

It may be configured to perform any of procedures shown in the flowcharts of FIG. 3, FIG. 4 and FIG. 5 or to combine some of procedures shown in the flowcharts of FIG. 3, FIG. 4 and FIG. 5, when the controlling unit 20 performs the processing at the step S4 shown in the flowchart of FIG. 2. It should be noted that the processing at the step S4 is not limited to the procedures shown in the flowcharts of FIG. 3, FIG. 4 and FIG. 5.

Next, it will be described in detail about the sound channel selection processing for each speaker which is performed at the step S5 shown in the flowchart of FIG. 2.

Figure 6:
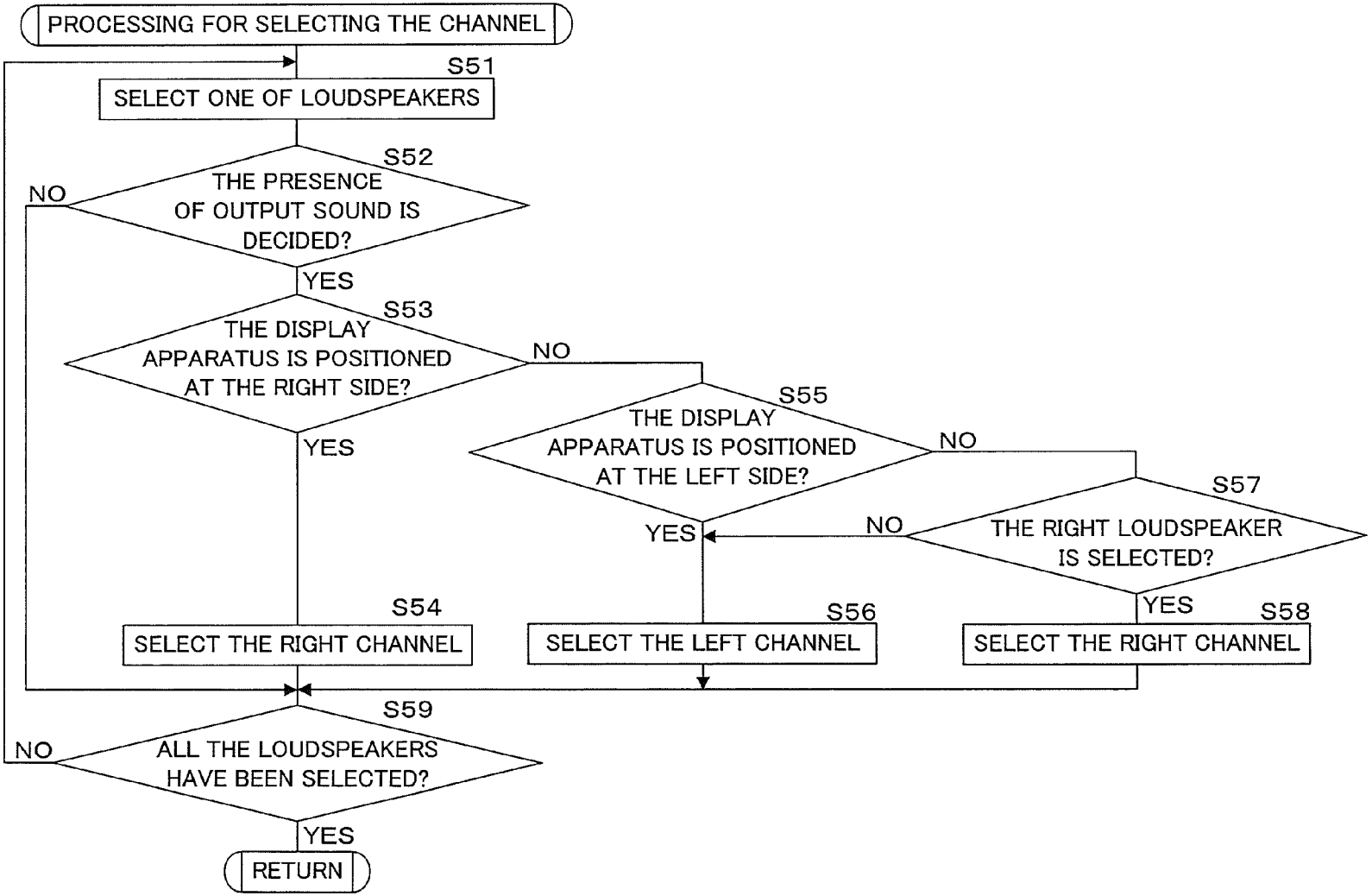
FIG. 6 is a flowchart showing an example of procedure for sound channel selection processing performed by the controlling unit included by the control apparatus of the embodiment 1.

FIG. 6 is a flowchart showing an example of procedure for the sound channel selection processing performed by the controlling unit 20 included by the control apparatus 2 of the embodiment 1.

The controlling unit 20 selects one of loudspeakers included in the selected display apparatus 1 (step S51), and determines whether the selected loudspeaker is decided (i.e., allowed) to output sound or not (step S52).

When having determined that the selected loudspeaker is not allowed to output sound (S52: NO), the controlling unit 20 proceeds to a step S59 described later.

When having determined that the selected loudspeaker is allowed to output sound (S52: YES), the controlling unit 20 determines in accordance with the obtained position information whether the selected display apparatus 1 is positioned at the right side of the juxtaposition display apparatus unit made with display apparatuses 1, 1, . . . configuring the multivision system (step S53).

When having determined that the selected display apparatus 1 is positioned at the right side (S53: YES), the controlling unit 20 selects the right channel as the sound channel utilized by the selected loudspeaker for outputting sound (step S54) and proceeds to the step S59 described later.

When having determined at the step S53 that the selected display apparatus 1 is not positioned at the right side (S53: NO), the controlling unit 20 determines whether the selected display apparatus 1 is positioned at the left side of the juxtaposition display apparatus unit made with display apparatuses 1, 1, . . . configuring the multivision system (step S55).

When having determined that the selected display apparatus 1 is positioned at the left side (S55: YES), the controlling unit 20 selects the left channel as the sound channel utilized by the selected loudspeaker for outputting sound (step S56) and proceeds to the step S59 described later.

When the controlling unit 20 has determined at the step S55 that the selected display apparatus 1 is not positioned at the left side (S55: NO), it is expected that the selected display apparatus 1 is positioned on the center line of the juxtaposition display apparatus unit made with display apparatuses 1, 1, . . . configuring the multivision system. Thus, the controlling unit 20 determines whether the loudspeaker selected at the step S51 is the right loudspeaker 13 or not (step S57).

When having determined at the step S57 that the selected loudspeaker is the right loudspeaker 13 (S57: YES), the controlling unit 20 selects the right channel as the sound channel utilized by the selected loudspeaker for outputting sound (step S58) and proceeds to the step S59 described later. As the right channel has been selected for the selected right loudspeaker 13, the controlling unit 20 may further select the left channel as the sound channel utilized by the left loudspeaker 12 of another display apparatus 1 positioned symmetrically to the selected display apparatus 1.

When having determined at the step S57 that the selected loudspeaker is not the right loudspeaker 13 (S57: NO), the controlling unit 20 selects the left channel as the sound channel utilized by the selected loudspeaker for outputting sound (S56) and proceeds to the step S59 described later.

The controlling unit 20 determines whether all loudspeakers have been selected or not (step S59). When having determined that all loudspeakers have not been selected (S59: NO), the controlling unit 20 returns the procedure to the step S51 and performs the procedure for the subsequent loudspeaker. When having determined that all loudspeakers have been selected (S59: YES), the controlling unit 20 ends the sound channel selection processing and returns to the step S6 shown in the flowchart of FIG. 2.

Since the controlling unit 20 performs the procedure shown in the flowchart of FIG. 6, the right channel sound is output from the loudspeaker allowed to output included in the display apparatus 1 juxtaposed at the right side of the juxtaposition display apparatus unit made with display apparatuses 1, 1, . . . configuring the multivision system, and the left channel sound is output from the loudspeaker allowed to output sound in the display apparatus 1 juxtaposed at the left side of the juxtaposition display apparatus unit made with display apparatuses 1, 1, . . . configuring the multivision system. In the display apparatus 1 juxtaposed on the center line, the right channel sound is output from the right loudspeaker 13 that is allowed to output sound, and the left channel sound is output from the left loudspeaker 12 that is allowed to output. Therefore, it is possible to prevent the multi-channel sound from being interfered, to prevent the decrease of sound effect, and to effectively output the multi-channel sound. Furthermore, it is possible to save the electric power consumption required for outputting sound from the whole multivision system because there is some loudspeakers outputting no sound.

Next, it will be described below in reference to the figures about a juxtaposition pattern of the juxtaposition display apparatus unit made with display apparatuses 1, 1, . . . , pattern of loudspeaker allowed to output sound and pattern of output sound channel.

Each of FIG. 7 to FIG. 19 is a schematic view showing a juxtaposition pattern of the juxtaposition display apparatus unit, a pattern of loudspeakers that output sound and a pattern of selected sound channels. In each figure, the cross mark represents the absence of allowance for outputting sound on each loudspeaker and the circle mark represents the presence of allowance for outputting sound on each loudspeaker. The letter in the circle mark represents the initial letter of selected sound channel (L: left channel; R: right channel; B: bass channel).

Figure 7:
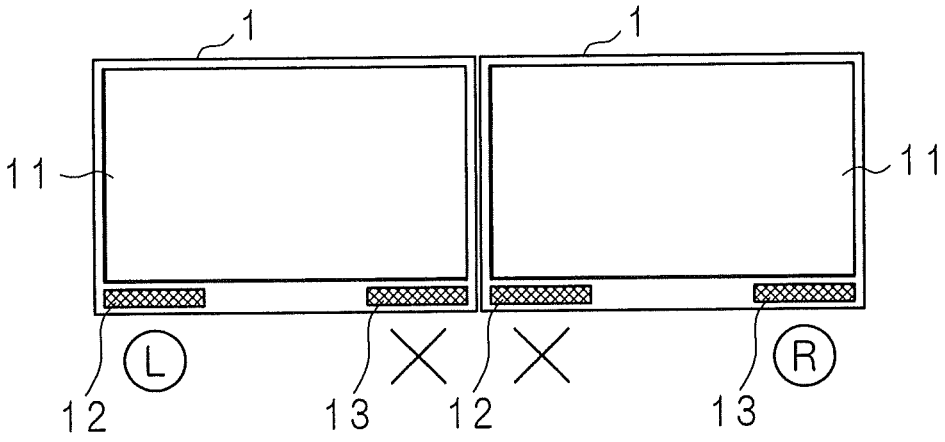
FIG. 7 is a schematic view showing a juxtaposition pattern of a juxtaposition display apparatus unit, a pattern of loudspeakers that output sound and a pattern of selected sound channels.

In the example of FIG. 7, two display apparatuses 1, 1 are juxtaposed to each other in the horizontal direction. The sound is allowed to be output only from the left loudspeaker 12 of the display apparatus 1 juxtaposed at the left side and from the right loudspeaker 13 of the display apparatus 1 juxtaposed at the right side while no sound is output from the other loudspeakers, as the controlling unit 20 decides the presence/absence of output sound with the procedure shown in the flowchart of FIG. 5. In addition, the left channel sound is output from the left loudspeaker 12 of the display apparatus 1 juxtaposed at the left side and the right channel sound is output from the right loudspeaker 13 of the display apparatus 1 juxtaposed at the right side, as the controlling unit 20 selects the sound channel with the procedure shown in the flowchart of FIG. 6. As shown in FIG. 7, the presence/absence of output sound is symmetrically decided, and the sound channel is also symmetrically selected.

Figure 8:
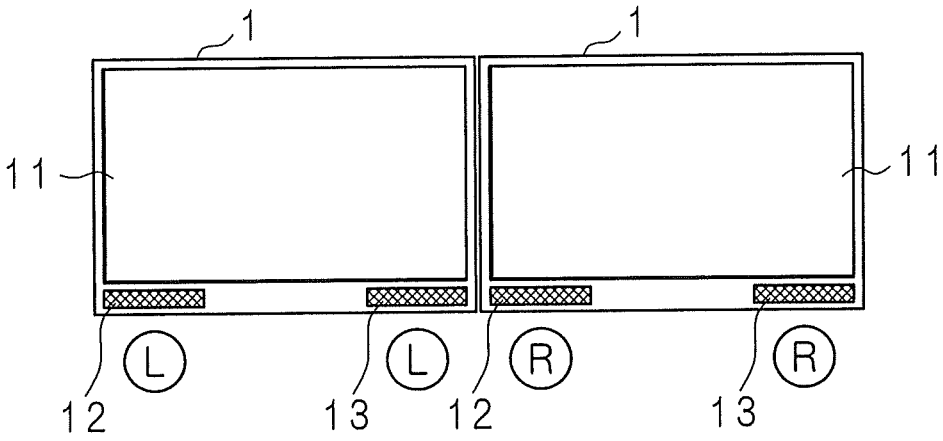
FIG. 8 is a schematic view showing another juxtaposition pattern of the juxtaposition display apparatus unit, another pattern of loudspeakers that output sound and another pattern of selected sound channels.

FIG. 8 illustrates other patterns of two display apparatuses 1, 1 juxtaposed to each other in the horizontal direction. The sound is allowed to be output from all the loudspeakers, as the controlling unit 20 decides whether or not sound is to be output with the procedure shown in the flowchart of FIG. 3. In addition, the left channel sound is output not only from the left loudspeaker 12 but also from the right loudspeaker 13 of the display apparatus 1 juxtaposed at the left side and the right channel sound is output not only from the right loudspeaker 13 but also from the left loudspeaker 12 of the display apparatus 1 juxtaposed at the right side, as the controlling unit 20 selects the sound channel with the procedure shown in the flowchart of FIG. 6.

Figure 9:
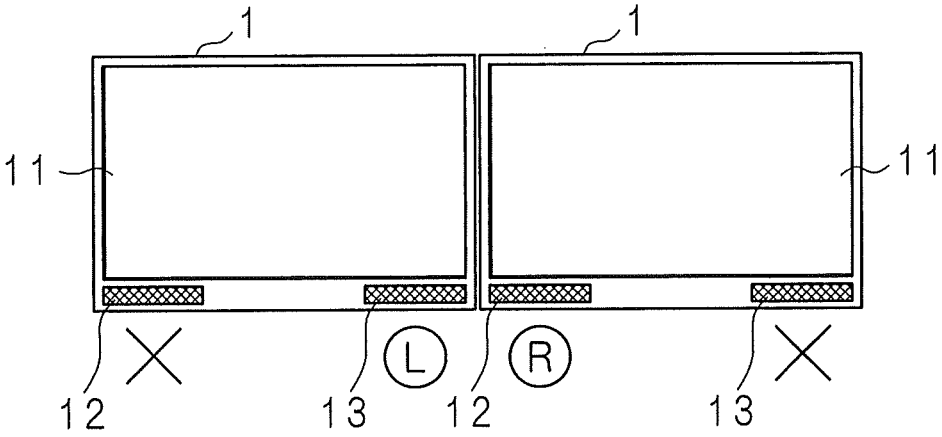
FIG. 9 is a schematic view showing another juxtaposition pattern of the juxtaposition display apparatus unit, another pattern of loudspeakers that output sound and another pattern of selected sound channels.

FIG. 9 illustrates other patterns of two display apparatuses 1, 1 juxtaposed in the horizontal direction. As shown in FIG. 9, the sound may be allowed to be output only from the right loudspeaker 13 of the display apparatus 1 juxtaposed at the left side and from the left loudspeaker 12 of the display apparatus 1 juxtaposed at the right side. Then, the left channel sound is output from the right loudspeaker 13 of the display apparatus 1 juxtaposed at the left side and the right channel sound is output from the left loudspeaker 12 of the display apparatus 1 juxtaposed at the right side, as the controlling unit 20 selects the sound channel with the procedure shown in the flowchart of FIG. 6.

Figure 10:
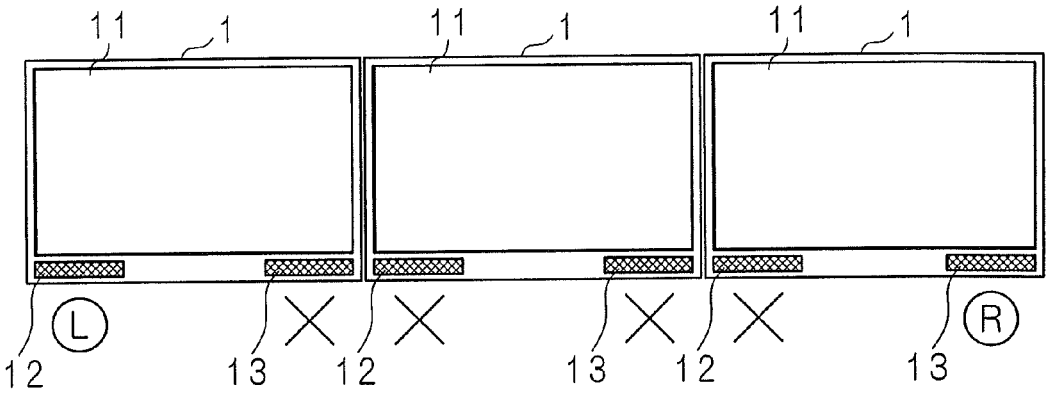
FIG. 10 is a schematic view showing another juxtaposition pattern of the juxtaposition display apparatus unit, another pattern of loudspeakers that output sound and another pattern of selected sound channels.

In the example of FIG. 10, three display apparatuses 1, 1, . . . are juxtaposed to each other in the horizontal direction. The sound is allowed to be output only from the left loudspeaker 12 of the display apparatus 1 juxtaposed at the left side and from the right loudspeaker 13 of the display apparatus 1 juxtaposed at the right side, as the controlling unit 20 decides whether or not sound is to be output with the procedure shown in the flowchart of FIG. 3 and the procedure shown in the flowchart of FIG. 5. No sound is output from the loudspeakers of the display apparatus 1 juxtaposed at the center. In addition, the left channel sound is output from the left loudspeaker 12 of the display apparatus 1 juxtaposed at the left side and the right channel sound is output from the right loudspeaker 13 of the display apparatus 1 juxtaposed at the right side, as the controlling unit 20 selects the sound channel with the procedure shown in the flowchart of FIG. 6.

Figure 11:
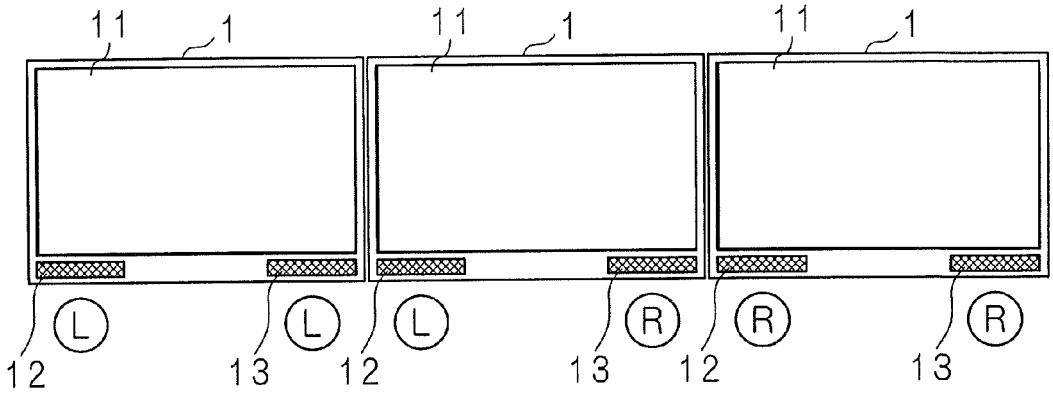
FIG. 11 is a schematic view showing another juxtaposition pattern of the juxtaposition display apparatus unit, another pattern of loudspeakers that output sound and another pattern of selected sound channels.

FIG. 11 illustrates another pattern with three display apparatuses 1, 1, . . . juxtaposed in the horizontal direction. As shown in FIG. 11, the sound may be allowed to be output from all the loudspeakers of all the display apparatuses 1, 1, . . . . In other words, the sound may be allowed to be output even from the loudspeakers of the display apparatus 1 juxtaposed at the center. The procedure shown in the flowchart of FIG. 4 may allow all the loudspeakers of all display apparatuses 1, 1, . . . to output sound, in such a structure having a single layer in the horizontal direction. Then, the left channel sound is output not only from the left loudspeaker 12 but also from the right loudspeaker 13 of the display apparatus 1 juxtaposed at the left side and the right channel sound is output not only from right loudspeaker 13 but also from the left loudspeaker 12 of the display apparatus 1 juxtaposed at the right side, as the controlling unit 20 selects the sound channel with the procedure shown in the flowchart of FIG. 6. Further, the left channel sound is output from the left loudspeaker 12 of the display apparatus 1 juxtaposed at the center and the right channel sound is output from the right loudspeaker 13 of the display apparatus 1 juxtaposed at the center.

Figure 12:
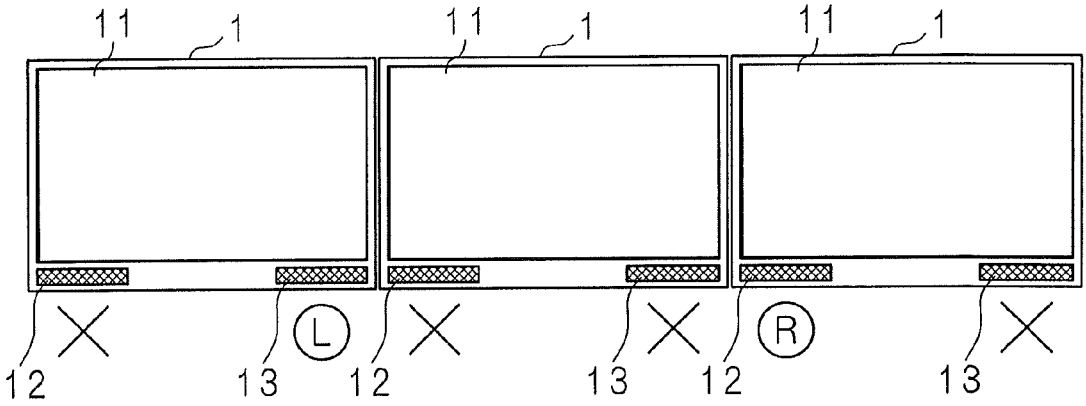
FIG. 12 is a schematic view showing another juxtaposition pattern of the juxtaposition display apparatus unit, another pattern of loudspeakers that output sound and another pattern of selected sound channels.

FIG. 12 illustrates another pattern with three display apparatuses 1, 1, . . . juxtaposed in the horizontal direction. As shown in FIG. 12, the sound may be allowed to be output only from the loudspeaker at the inner side among the loudspeakers included in each display apparatus 1 juxtaposed at the most outer side, but the sound may be allowed to be output from none of loudspeakers included in the display apparatus 1 juxtaposed at the center. Then, the left channel sound is output from the allowed right loudspeaker 13 of the display apparatus 1 juxtaposed at the left side and the right channel sound is output from the allowed left loudspeaker 12 of the display apparatus 1 juxtaposed at the right side, as the controlling unit 20 selects the sound channel with the procedure shown in the flowchart of FIG. 6.

Figure 13:
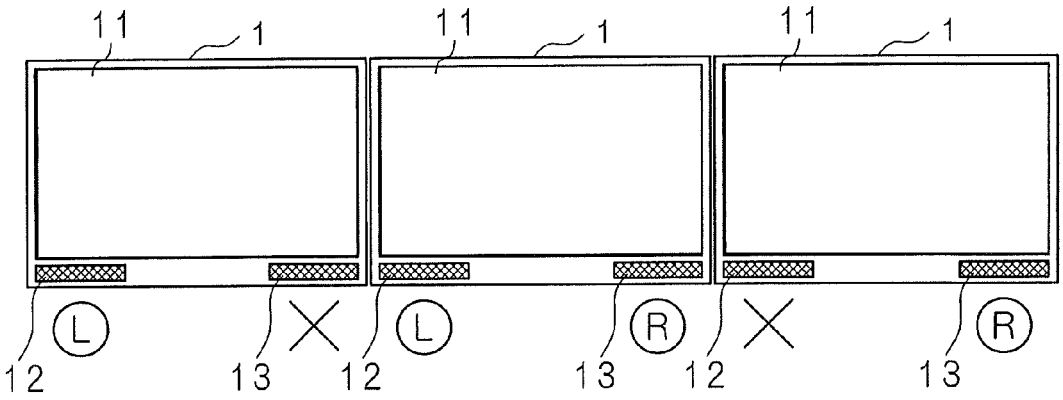
FIG. 13 is a schematic view showing another juxtaposition pattern of the juxtaposition display apparatus unit, another pattern of loudspeakers that output sound and another pattern of selected sound channels.

FIG. 13 illustrates another pattern with three display apparatuses 1, 1, . . . juxtaposed in the horizontal direction. As shown in FIG. 13, for the loudspeakers included in the outermost display device 1, the procedure shown in the flowchart of FIG. 5 may allow only the left loudspeaker 12 of the display apparatus 1 juxtaposed at the left side and the right loudspeaker 13 of the display apparatus 1 juxtaposed at the right side, to output the sound. As shown in FIG. 13, the sound may be allowed to be output from all the loudspeakers of the display apparatus 1 juxtaposed at the center. Then, the left channel sound is output from the allowed left loudspeaker 12 of the display apparatus 1 juxtaposed at the left side and from the allowed left loudspeaker 12 of the display apparatus 1 juxtaposed at the center, and the right channel sound is output from the allowed right loudspeaker 13 of the display apparatus 1 juxtaposed at the right side and from the allowed right loudspeaker 13 of the display apparatus 1 juxtaposed at the center, as the controlling unit 20 selects the sound channel with the procedure shown in the flowchart of FIG. 6.

Figure 14:
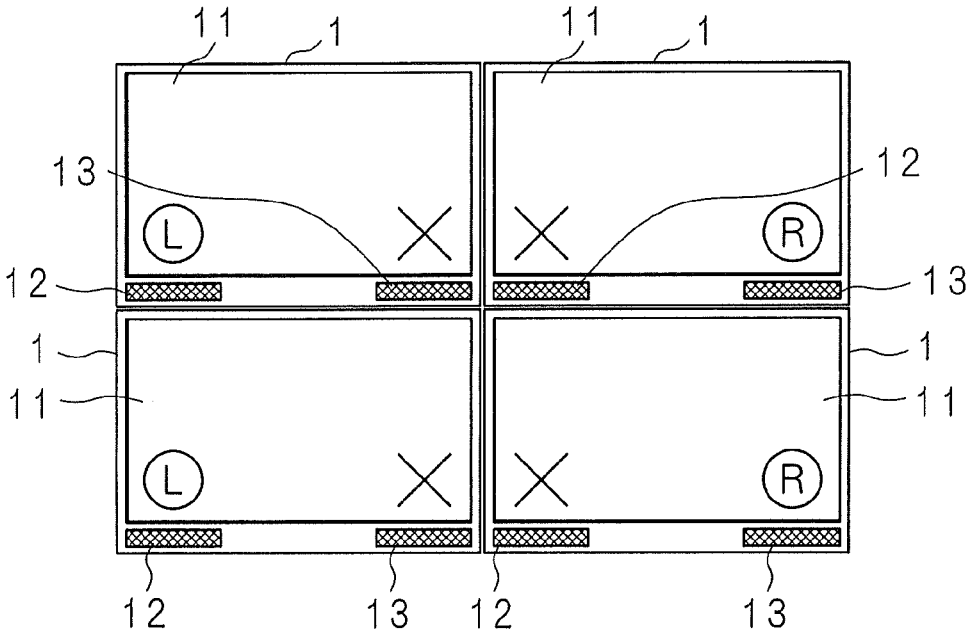
FIG. 14 is a schematic view showing another juxtaposition pattern of the juxtaposition display apparatus unit, another pattern of loudspeakers that output sound and another pattern of selected sound channels.

In the example of FIG. 14, four display apparatuses 1, 1, are juxtaposed to form horizontally aligned two vertical lanes and vertically aligned two layers. The sound is allowed to be output only from the left loudspeakers 12, 12 of the display apparatuses 1, 1 juxtaposed at the left side and from the right loudspeakers 13, 13 of the display apparatuses 1, 1 juxtaposed at the right side, as the controlling unit 20 decides whether or not sound may be output with the procedure shown in the flowchart of FIG. 5. However, the sound is allowed to be output from none of the other loudspeakers. Then, the left channel sound is output from the left loudspeakers 12, 12 of the display apparatuses 1, 1 juxtaposed at the left side, and the right channel sound is output from the right loudspeakers 13, 13 of the display apparatuses 1, 1 juxtaposed at the right side, as the controlling unit 20 selects the sound channel with the procedure shown in the flowchart of FIG. 6. Therefore, it is possible to clarify the difference between the left channel sound and the right channel sound, and to effectively output the stereo sound.

Figure 15:
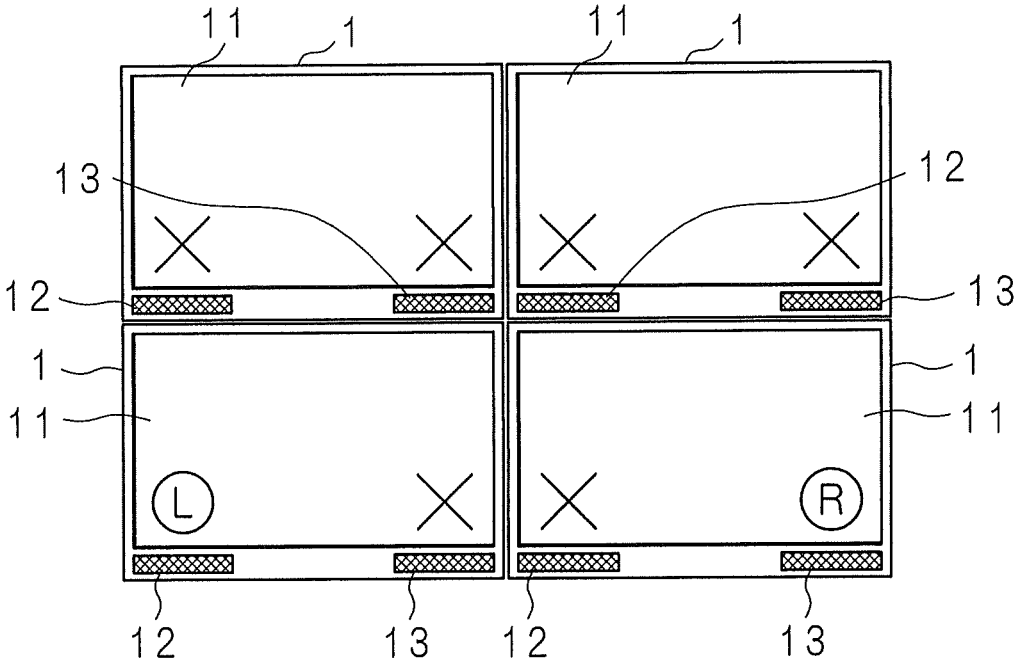
FIG. 15 is a schematic view showing another juxtaposition pattern of the juxtaposition display apparatus unit, another pattern of loudspeakers that output sound and another pattern of selected sound channels.

FIG. 15 illustrates another pattern with four display apparatuses 1, 1, . . . juxtaposed to form horizontally aligned two vertical lanes and vertically aligned two layers. The sound is allowed to be output only from the left loudspeaker 12 of the display apparatus 1 juxtaposed at the left side in the lower layer and from the right loudspeaker 13 of the display apparatus 1 juxtaposed at the right side in the lower layer, as the controlling unit 20 decides whether or not sound may be output with the procedure shown in the flowchart of FIG. 4 and with the procedure shown in the flowchart of FIG. 5. Then, the left channel sound is output from the left loudspeaker 12 of the display apparatus 1 juxtaposed at the left side in the lower layer, and the right channel sound is output from the right loudspeaker 13 of the display apparatus 1 juxtaposed at the right side in the lower layer, as the controlling unit 20 selects the sound channel with the procedure shown in the flowchart of FIG. 6. Therefore, it is possible to clarify the difference between the left channel sound and the right channel sound, and to effectively output the stereo sound.

Figure 16:
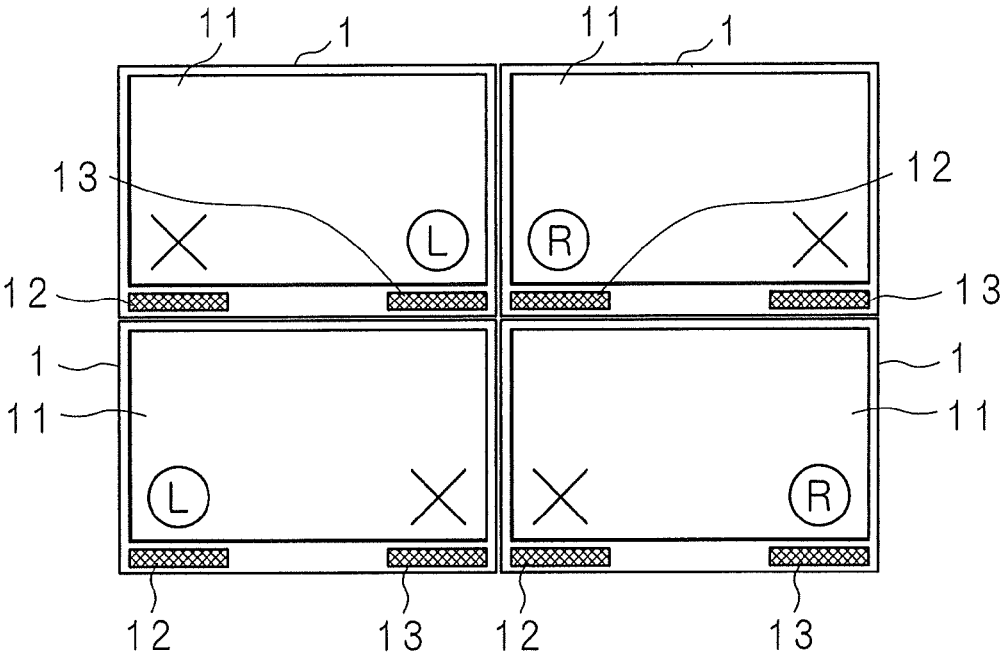
FIG. 16 is a schematic view showing another juxtaposition pattern of the juxtaposition display apparatus unit, another pattern of loudspeakers that output sound and another pattern of selected sound channels.

FIG. 16 illustrates another pattern with four display apparatuses 1, 1, . . . juxtaposed to form the structure with horizontally-aligned two vertical lanes and vertically aligned two layers. As shown in FIG. 16, the allowed loudspeakers in the first layer may be flip-flopped in the second layer. The allowed loudspeakers are decided to be symmetrical and the selected sound channels also determined to be symmetrical. Then, the left channel sound is output from the loudspeakers of the display apparatuses 1, 1 juxtaposed at the left side, and the right channel sound is output from the loudspeakers of the display apparatuses 1, 1 juxtaposed at the right side, as the controlling unit 20 selects the sound channel with the procedure shown in the flowchart of FIG. 6.

Figure 17:
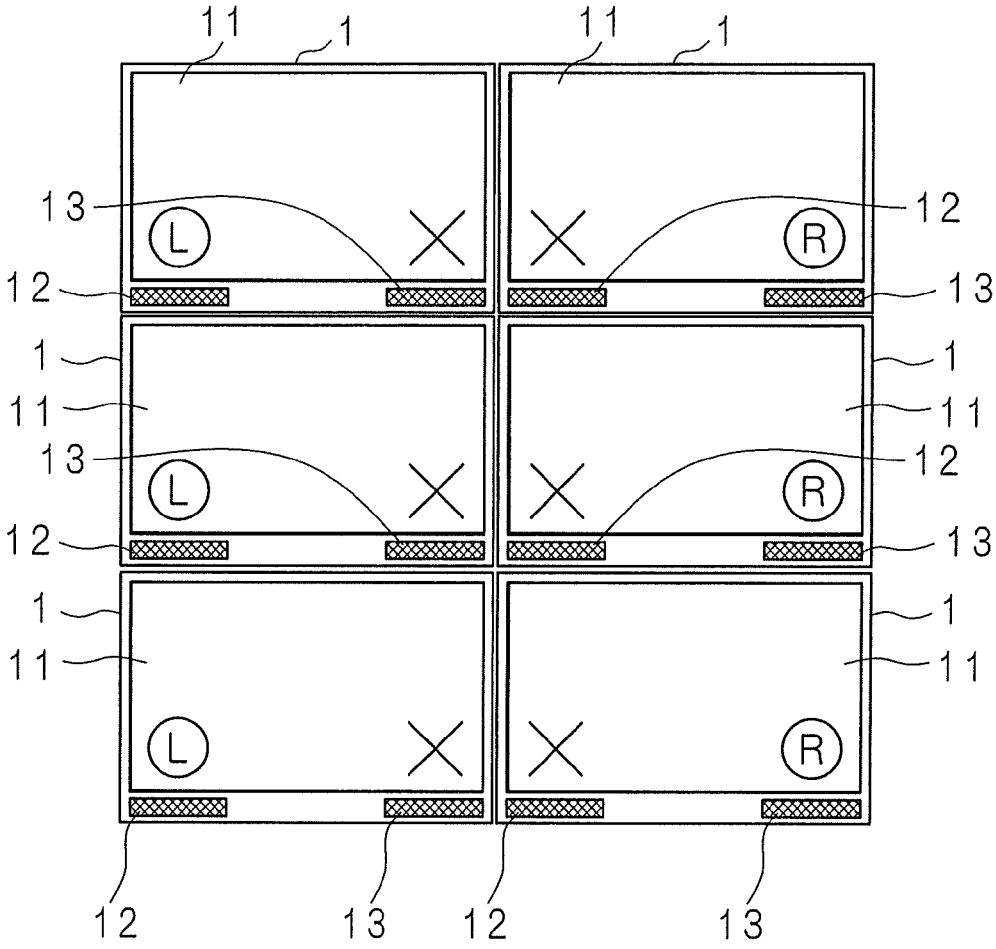
FIG. 17 is a schematic view showing another juxtaposition pattern of the juxtaposition display apparatus unit, another pattern of loudspeakers that output sound and another pattern of selected sound channels.

In the example of FIG. 17, six display apparatuses 1, 1, . . . are juxtaposed to form the structure with horizontally-aligned two vertical lanes and vertically aligned three layers. The sound is allowed to be output only from the left loudspeakers 12, 12, . . . of the display apparatuses 1, 1, . . . juxtaposed at the left side and from the right loudspeakers 13, 13, . . . of the display apparatuses 1, 1, . . . juxtaposed at the right side, as the controlling unit 20 decides whether or not sound may be output with the procedure shown in the flowchart of FIG. 5. However, the sound is allowed to be output from none of the other loudspeakers. Then, the left channel sound is output from the left loudspeakers 12, 12, . . . of the display apparatuses 1, 1, . . . juxtaposed at the left side, and the right channel sound is output from the right loudspeakers 13, 13, . . . of the display apparatuses 1, 1, . . . juxtaposed at the right side, as the controlling unit 20 selects the sound channel with the procedure shown in the flowchart of FIG. 6. Therefore, it is possible to clarify the difference between the left channel sound and the right channel sound, and to effectively output the stereo sound.

In the example of FIG. 17, the sound may be alternatively allowed to be output from none of loudspeakers of two display apparatuses 1, 1 juxtaposed in the second layer, as the controlling unit 20 changes the presence/absence of output sound every other layer. Therefore, it is possible to save the electric power consumption required for outputting sound from the whole multivision system.

Figure 18:
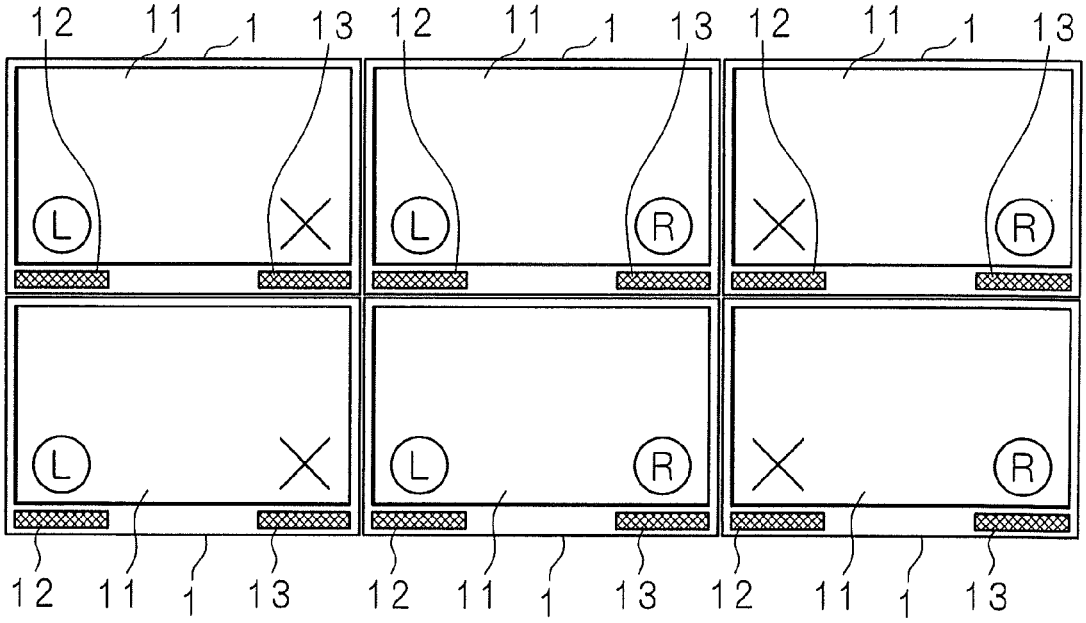
FIG. 18 is a schematic view showing another juxtaposition pattern of the juxtaposition display apparatus unit, another pattern of loudspeakers that output sound and another pattern of selected sound channels.

In the example of FIG. 18, six display apparatuses 1, 1, . . . are juxtaposed to form the structure with horizontally aligned three vertical lanes and vertically aligned two layers. Similarly to the example of FIG. 13 where three display apparatuses 1, 1, . . . are juxtaposed to each other, the sound is allowed to be output only from the loudspeakers of the display apparatuses 1, 1, . . . juxtaposed at the most outer side, i.e., the left loudspeakers 12, 12 of the display apparatuses 1, 1 juxtaposed at the left side and the right loudspeakers 13, 13 of the display apparatuses 1, 1 juxtaposed at the right side, as the controlling unit 20 decides the presence/absence of sound output with the procedure shown in the flowchart of FIG. 5. Then, the left channel sound is output from the allowed left loudspeakers 12, 12, . . . of the display apparatuses 1, 1, . . . juxtaposed at the left side and at the center, and the right channel sound is output from the allowed right loudspeakers 13, 13, . . . of the display apparatuses 1, 1, . . . juxtaposed at the right side and the center, as the controlling unit 20 selects the sound channel with the procedure shown in the flowchart of FIG. 6.

In the case that six display apparatuses 1, 1, . . . are juxtaposed to form the structure with horizontally aligned three vertical lanes and vertically aligned two layers as shown in FIG. 18, the sound may be alternatively allowed to be output only from the left loudspeakers 12, 12 of the display apparatuses 1, 1 juxtaposed at the left side in the upper and lower layers, and from the right loudspeakers 13, 13 of the display apparatuses 1, 1 juxtaposed at the right side in the upper and lower layers.

Figure 19:
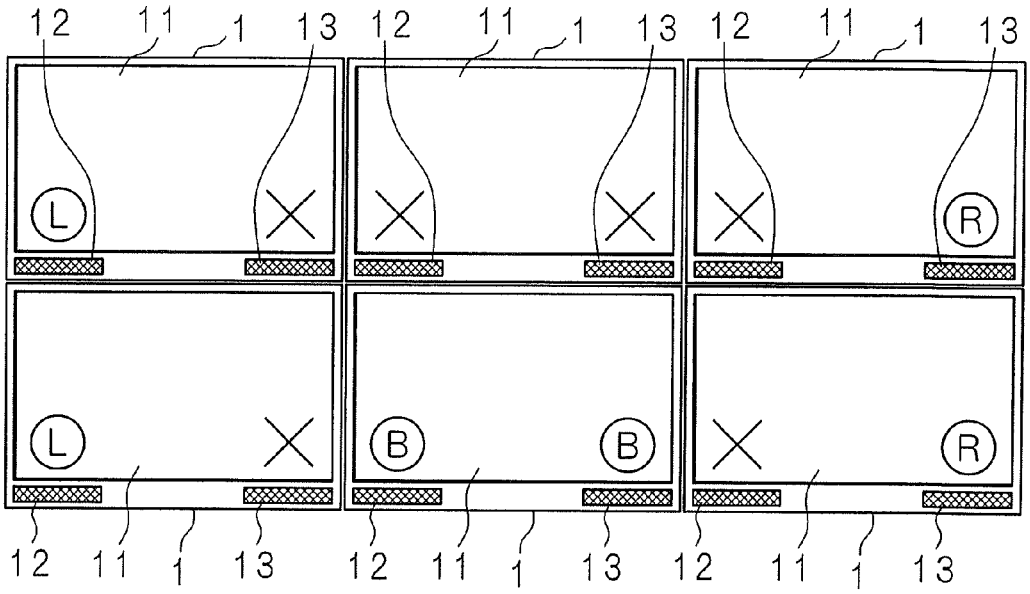
FIG. 19 is a schematic view showing another juxtaposition pattern of the juxtaposition display apparatus unit, another pattern of loudspeakers that output sound and another pattern of selected sound channels.

FIG. 19 illustrates another pattern with six display apparatuses 1, 1, . . . juxtaposed to form the structure with horizontally aligned three vertical lanes and vertically aligned two layers. As shown in FIG. 19, the sound may be allowed to be output only from the left loudspeakers 12, 12 of the display apparatuses 1, 1 juxtaposed at the left side in the upper and lower layers, from the right loudspeakers 13, 13 of the display apparatuses 1, 1 juxtaposed at the right side in the top and lower layers, and from the loudspeakers 12, 13 of the display apparatus 1 juxtaposed at the center in the lower layer. Then, the left channel sound is output from the left loudspeakers 12, 12 of the display apparatuses 1, 1 juxtaposed at the left side, and the right channel sound is output from the right loudspeakers 13, 13 of the display apparatuses 1, 1 juxtaposed at the right side, as the controlling unit 20 selects the sound channel with the procedure shown in the flowchart of FIG. 6. In addition, the controlling unit 20 may select the deep bass channel for the loudspeakers 12, 13 of the display apparatus 1 juxtaposed in the lower layer at the center of juxtaposition display apparatus unit made with display apparatuses 1, 1, . . . configuring the multivision system as shown in FIG. 19. Therefore, it is possible to effectively output the 2.1ch surround sound.

(Embodiment 2)

In the Embodiment 1, the Controlling Unit 20 is Configured to decide the loudspeaker that should output the sound and to select the channel for the sound output from the decided loudspeaker, in accordance with any one of or a combination of procedures as shown in the flowcharts of FIG. 3 to FIG. 6. In other words, the controlling unit 20 in the embodiment 1 is configured to decide the loudspeaker and to select the sound channel in accordance with the previously provided program. However, the embodiment 2 is configured to allow a user to select the loudspeaker that should output the sound.

The configurations of display system in the embodiment 2 is similar to those in the embodiment 1, although the controlling unit 20 of the control apparatus further performs another processing described below. Thus, the same numerals are provided to these similar configurations that are not explained in detail below.

Figure 20:
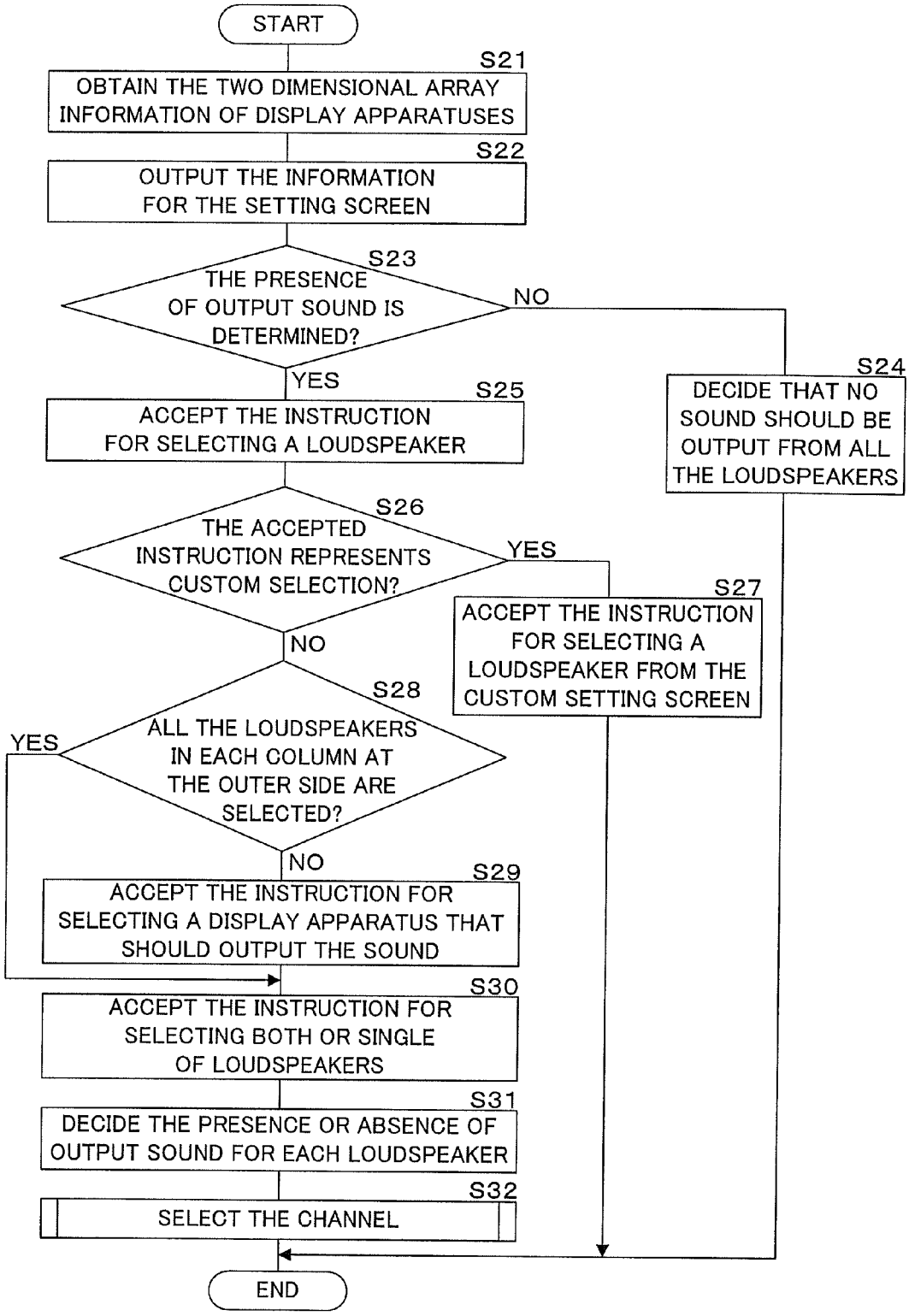
FIG. 20 is a flowchart showing an example of procedure for the sound output control processing performed by the controlling unit included by the control apparatus that consists in the display system of an embodiment 2.

FIG. 20 is a flowchart showing an example of procedure for the sound output control processing performed by the controlling unit 20 included by the control apparatus 2 that consists in the display system of the embodiment 2.

The controlling unit 20 obtains juxtaposition information of display apparatuses 1, 1, . . . connected to the control apparatus 2 (step S21). The juxtaposition information in the embodiment 2 is similar to the juxtaposition information in the embodiment 1.

The controlling unit 20 outputs information on the setting screen for receiving selection by the user to any of the connected display apparatuses 1, 1, . . . (step S22). Thus, the setting screen image is displayed on any or whole of the juxtaposition display apparatus unit made with display apparatuses 1, 1, . . . configuring the multivision system. The user can perform various selection with the user interface connected to the inputting unit 23.

The controlling unit 20 accepts the instruction through the setting screen whether the whole display system should output the sound or not, and determines whether or not selection has been made to output the sound (step S23). When having determined with the user's instruction that the whole display system should not output the sound (S23: NO), the controlling unit 20 decides that the sound should be output from none of loudspeakers (step S24), and ends the procedure.

When having determined that the selection has been made to output the sound (S23: YES), the controlling unit 20 is prompted to accept the instruction for selecting loudspeakers, i.e., how to select loudspeakers, through the setting screen (step S25).

The controlling unit 20 determines whether the accepted instruction represents custom selection or not (step S26). When having determined that the accepted instruction represents the custom selection (S26: YES), the controlling unit 20 outputs information for the custom setting screen, is prompted to accept the instruction through the custom setting screen for the presence/absence of output sound and for the sound channel to be output from each loudspeaker (step S27), and ends the procedure.

When having determined that the accepted instruction does not represent the custom selection (S26: NO), the controlling unit 20 performs partial auto setting. Then, the controlling unit 20 determines whether a user inputs the instruction through the setting screen to perform the selection for all loudspeakers in each vertical lane at the outer side of the juxtaposition display apparatus unit made with display apparatuses 1, 1, . . . configuring the multivision system (step S28).

When having determined that the user does not input the instruction to perform the selection for all loudspeakers in each vertical lane at the outer side (S28: NO), the controlling unit 20 determines that the user will perform the selection for loudspeakers of each display apparatus 1 in the juxtaposition display apparatus unit, and prompts to accept the instruction through the setting screen for selecting the display apparatus 1 that should output the sound (step S29). In order to implement the partial auto selection, display apparatuses 1, 1, . . . in each layer can be selected through the setting screen. For example, the setting screen shows a button for selecting display apparatuses 1, 1, . . . in the upper layer, a button for selecting display apparatuses 1, 1, . . . in the middle layer, and a button for selecting display apparatuses 1, 1, . . . in the lower layer, to accept the instruction for the selection.

Next, the controlling unit 20 is prompted to accept the instruction on whether the sound should be output from one of the left and right loudspeakers 12, 13, or from both of them (step S30), for the display apparatus 1 selected as using a loudspeaker, i.e., the apparatus from which sound is to be output. In the case of having determined at the step S28 that the user inputs the instruction to perform the selection for all loudspeakers in each vertical lane at the outer side (S28: YES), the controlling unit 20 is prompted to accept the instruction whether the sound should be output from one of the left and right loudspeakers 12, 12, . . . , 13, 13, . . . of the display apparatuses in the same vertical lane or from both of them (S30).

Based on the instruction accepted at the step S30, the controlling unit 20 decides the presence/absence of output sound for each loudspeaker included in the display apparatus whose loudspeakers are selected to have allowance for outputting the sound (step S31). Particularly, when both of the left and right loudspeakers of each display apparatus are selected to output the sound, all the loudspeakers of the target display apparatus 1 to be utilized are decided to output the sound at the step S31. However, when one of the left and right loudspeakers of each display apparatus is selected to output the sound, it is decided at the step S31 to output the sound only from the right loudspeakers of display apparatuses 1, 1, . . . whose position information represent to be at the right side and from the left loudspeakers of display apparatuses 1, 1, . . . whose position information represent to be at the left side.

After deciding the presence/absence of output sound for each loudspeaker, the controlling unit 20 selects the channel of each loudspeaker (i.e., each of the left loudspeaker 12 and right loudspeaker 13) included in the display apparatus 1 selected to be utilized, in accordance with the identified juxtapositions of respective display apparatuses 1, 1, . . . (step S32). Then, the controlling unit 20 ends the procedure. The step S32 corresponds to the procedure shown in the flowchart of FIG. 6.

Figure 21:
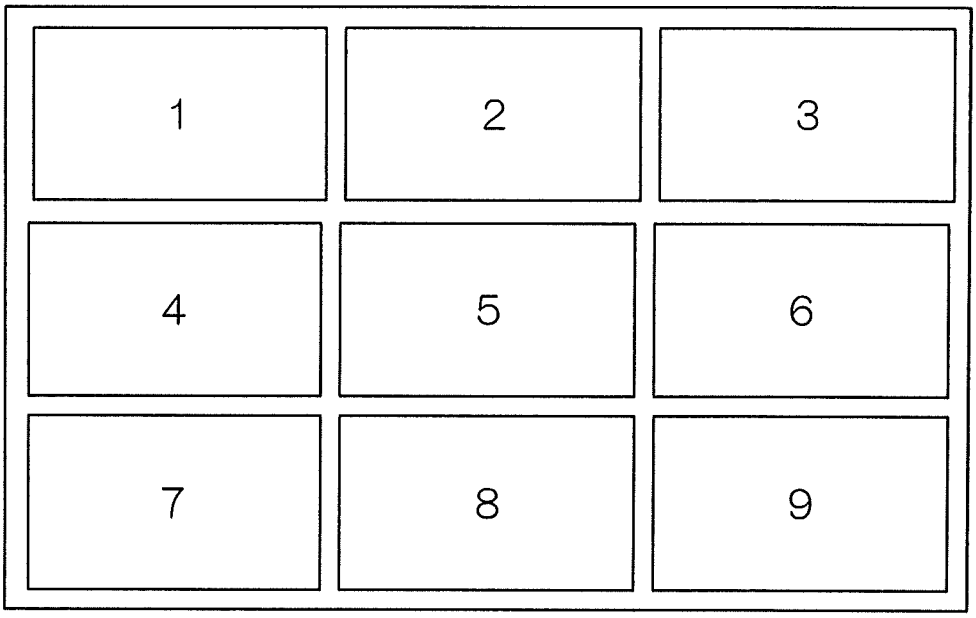
FIG. 21 is a schematic view for explaining an example of custom setting screen output by the controlling unit of the embodiment 2.
Figure 22:
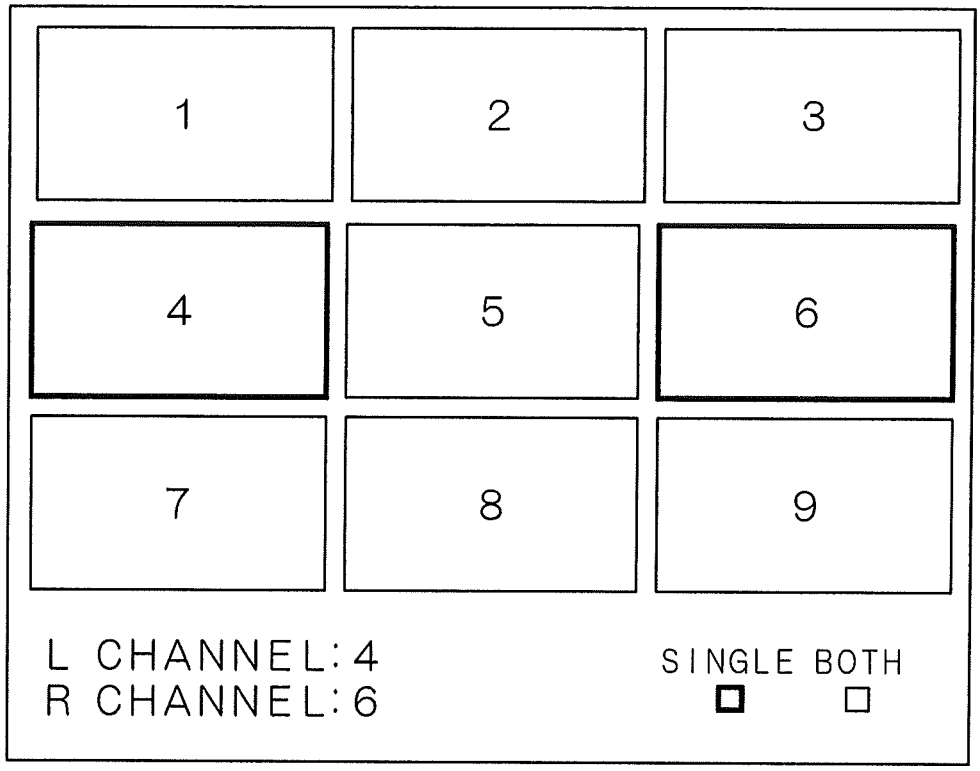
FIG. 22 is a schematic view for explaining another example of custom setting screen output by the controlling unit of the embodiment 2.
Figure 23:
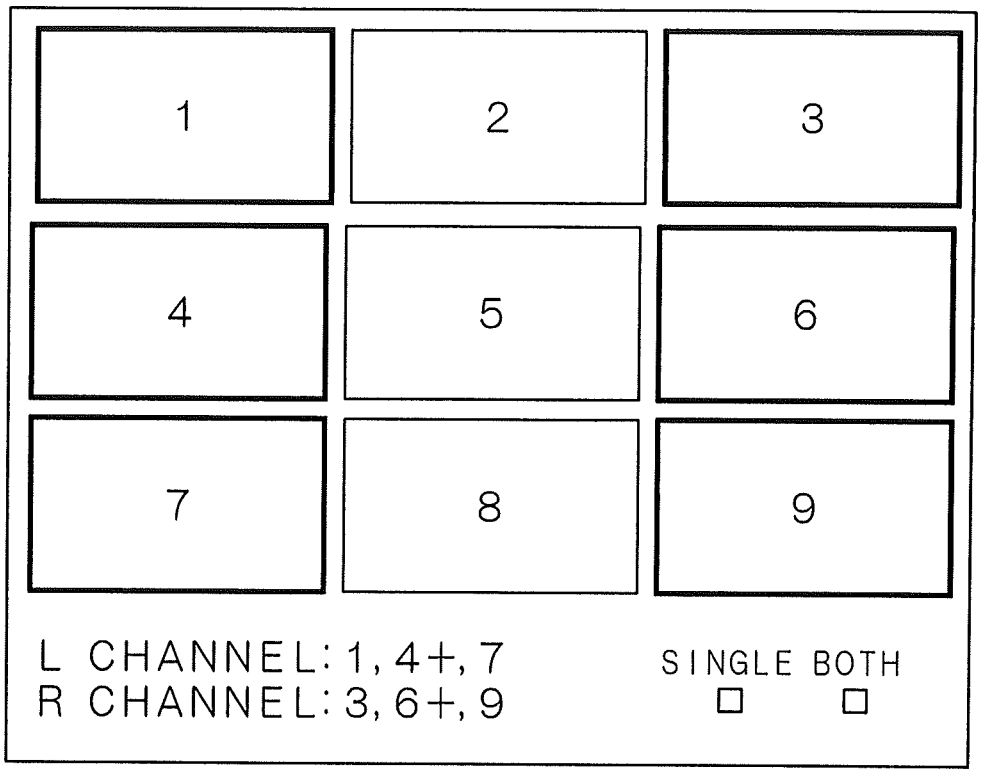
FIG. 23 is a schematic view for explaining another example of custom setting screen output by the controlling unit of the embodiment 2.

FIG. 21, FIG. 22 and FIG. 23 are schematic views for explaining examples of custom setting screen output by the controlling unit 20 of the embodiment 2.

FIG. 21 illustrates the identified juxtapositions based on the obtained position information for the juxtaposition display apparatus unit made with the display apparatuses 1, 1, . . . configuring the multivision system. In the example of FIG. 21, nine display apparatuses 1, 1, . . . are juxtaposed to form the structure with three layers and three vertical lanes. Each display apparatus 1 is identified by the numbers 1-9. In the example of FIG. 21, the identification information "1" is assigned to the display apparatus 1 juxtaposed at the upper-left side (e.g., position information [0, 0]), and the identification information "9" is assigned to the display apparatus 1 juxtaposed at the lower-right side (e.g., position information [2, 2]).

When the custom setting screen shown in FIG. 21 is displayed on the display apparatus 1, the user can utilize the mouse, the direction keys of keyboard and the like, to select the display apparatus 1 whose loudspeaker is utilized.

FIG. 22 illustrates an example of the screen displayed when the user selects the display apparatus 1 whose identification information is "4". When the user selects the display apparatus 1 whose identification information is "4", the controlling unit 20 decides to also utilize the loudspeakers of the display apparatus 1 whose identification information is "6"

juxtaposed symmetrically to the display apparatus 1 whose identification information is "4" about the center of the juxtaposition display apparatus unit made with display apparatuses 1, 1, . . . configuring the multivision system. At that time, the controlling unit 20 identifies the position (1, 2) which is symmetrical about the center (1, 1) to the position information (1, 0) of the display apparatus whose identification information is "4". Then, the controlling unit 20 identifies the display apparatus 1 whose identification information is "6" and whose position information is (1, 2), as the display apparatus 1 juxtaposed symmetrically to the display apparatus whose identification information is "4".

In addition, the custom setting screen of FIG. 22 shows the identification number of the display apparatus 1 that should output the left channel sound and the identification number of the display apparatus 1 that should output the right channel sound. It is possible to select, with the boxes at the lower right side of the custom setting screen of FIG. 22, whether one of the left and right loudspeakers is utilized in each display apparatus 1 or both of them are utilized in each display apparatus 1. In the custom setting screen of FIG. 22, it is selected by the default to utilize one of the left and right loudspeakers. Thus, it is selected to utilize one of the left and right loudspeakers in the selected display apparatus 1 whose identification information is "4" and in the symmetrically corresponding display apparatus 1 whose identification information is "6". Therefore, the left channel is selected for the display apparatus 1 whose identification information is "4" and whose position information represents to be the left side, and the right channel is selected for the display apparatus 1 whose identification information is "6" and whose position information represents to be the right side.

FIG. 23 illustrates an example of the screen displayed when the user selects the display apparatuses 1, 1, . . . whose identification information are "1", "4" and "7", respectively. When the user selects the display apparatuses 1, 1, . . . whose identification information are "1", "4" and "7", the controlling unit 20 decides to utilize the loudspeakers of the display apparatuses 1, 1, . . . whose identification information are "3", "6" and "9" and which are respectively juxtaposed symmetrically to the display apparatuses 1, 1, . . . whose identification information are "1", "4" and "7".

The custom setting screen of FIG. 23 shows identification numbers of display apparatuses 1, 1, . . . that should output right channel sound and left channel sound, respectively. In addition, the mark "+" is applied to the identification number "4" and "6". The mark "+" represents to utilize both the left and right loudspeakers. It should be noted that the decision is performed to symmetrically arrange the allowed loudspeakers in the display apparatuses 1, 1, . . . juxtaposed symmetrically.

As described above, the user can perform the selection freely and it is possible to facilitate setting for various structures of display system. Although the user can freely select the display apparatus 1 whose loudspeaker is utilized, it is possible to keep the symmetry of output sound in the case that the user is allowed to select whether the display apparatuses at the outer side should be utilized, whether the display apparatuses in the upper/middle/lower layer should be utilized, or the like. In addition, the proper channel is automatically selected by the control apparatus 2. Therefore, well-balanced output of the left and right sound can be attained.

It should be understood that the embodiments described herein are only illustrative of the present invention and that various modifications may be made thereto without departing from the scope of the invention as defined in the appended claims.

What is claimed is:

1. A display system for outputting a sound and an image, comprising:

plural display apparatuses, each of which comprises a panel for displaying an image and a loudspeaker for outputting a sound; and a control apparatus comprising a cpu and memory containing a control program, wherein the control apparatus controls sounds output from the plural display apparatuses, and identifies a relative position of each display apparatus relative to the plural display apparatuses, wherein the control apparatus refers to a position of each display apparatus to control a sound output from each loudspeaker and, if a sound is to be output, select a channel for the sound that should be output from each loudspeaker in accord with the relative position of the display apparatus as identified, each display apparatus is formed with two integral loudspeakers, a first loudspeaker being located on the left side of said each display apparatus and a second loudspeaker being located on the right side of said each display apparatus, and the control apparatus receives information whether one side loudspeaker or both sides loudspeakers are utilized by each display apparatus and the received information represents the presence or absence of sound output from such loudspeaker.

2. A display system according to claim 1, an image controlling unit that controls images displayed with the plural display apparatuses, wherein the control apparatus controls images displayed with the plural display apparatuses, and a single image can be displayed with whole of all the panels in the plural display apparatuses by the control apparatus.

3. A display system according to claim 2, wherein the control apparatus outputs a screen for selecting a display apparatus to be controlled on a panel of a display apparatus among the plural display apparatuses.

4. A display system according to claim 1, wherein the control apparatus selects a right channel for a loudspeaker of the display apparatus that is identified to be positioned at a right side relative to the plural display apparatuses, and selects a left channel for a loudspeaker of the display apparatus that is identified to be positioned at a left side relative to the plural display apparatuses.

5. A display system according to claim 1, wherein the control apparatus identifies a second display apparatus that is positioned symmetrically to the display apparatus comprising the loudspeaker whose channel has been selected for a sound to be output, and selects a channel for sound to be output from the second display apparatus, different from the channel having been selected for the loudspeaker of the display apparatus.

6. A display system according to claim 1, wherein the control apparatus receives information whether loudspeakers of a display apparatus at an outer side of the plural display apparatuses being aligned are utilized or not.

* * * * *